US007195064B2

(12) United States Patent
Cook et al.

(10) Patent No.: US 7,195,064 B2
(45) **Date of Patent: *Mar. 27, 2007**

(54) MONO-DIAMETER WELLBORE CASING

(75) Inventors: Robert Lance Cook, Katy, TX (US); Lev Ring, Houston, TX (US)

(73) Assignee: Enventure Global Technology, Houston, TX (US)

( * ) Notice: Subject to any disclaimer, the term of this patent is extended or adjusted under 35 U.S.C. 154(b) by 205 days.

This patent is subject to a terminal disclaimer.

(21) Appl. No.: 10/644,101

(22) Filed: Aug. 13, 2003

(65) Prior Publication Data

US 2004/0262014 A1 Dec. 30, 2004

Related U.S. Application Data

(63) Continuation of application No. PCT/US02/04353, filed on Feb. 14, 2002, and a continuation-in-part of application No. 09/454,139, filed on Dec. 3, 1999, now Pat. No. 6,497,289.

(60) Provisional application No. 60/270,007, filed on Feb. 20, 2001, provisional application No. 60/111,293, filed on Dec. 7, 1998.

(51) Int. Cl.
*E21B 43/10* (2006.01)
*E21B 29/10* (2006.01)

(52) U.S. Cl. ..... 166/277; 166/207; 166/212; 166/242.1

(58) Field of Classification Search ..... 166/277, 166/297, 298, 381, 384, 55, 55.1, 206, 207, 166/208, 212, 242.8
See application file for complete search history.

(56) References Cited

U.S. PATENT DOCUMENTS 46,818 A 3/1865 Patterson (Continued)

FOREIGN PATENT DOCUMENTS

AU 767364 2/2004

(Continued)

OTHER PUBLICATIONS

Halliburton Energy Services, "Halliburton Completion Products" 1996, Page Packers 5-37, United States of America.

(Continued)

*Primary Examiner*—Jennifer H. Gay
(74) *Attorney, Agent, or Firm*—Haynes and Boone LLP; Todd Mattingly

(57) ABSTRACT

A device for forming a wellbore casing in a borehole, according to which the device includes a support member including a first fluid passage, and an expansion cone coupled to the support member. The support member includes a second fluid passage, which is fluidicly coupled to the first fluid passage. The device further includes an expandable tubular liner movably coupled to the expansion cone, and an expandable shoe coupled to the expandable tubular liner.

39 Claims, 29 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,627,891 | A | 2/1953 | Clark |
| 2,647,847 | A | 8/1953 | Black et al. |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,528,498 | A | 9/1970 | Carothers |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahistone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinley et al. |
| 3,797,259 | A | 3/1974 | Kammerer, Jr. |
| 3,812,912 | A | 5/1974 | Wuenschel |
| 3,818,734 | A | 6/1974 | Bateman |
| 3,834,742 | A | 9/1974 | McPhillips |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,970,336 | A | 7/1976 | O'Sickey et al. |
| 3,977,473 | A | 8/1976 | Page |
| 3,989,280 | A | 11/1976 | Schwarz |
| 3,997,193 | A | 12/1976 | Tsuda et al. |
| 4,011,652 | A | 3/1977 | Black |
| 4,019,579 | A | 4/1977 | Thuse |
| 4,026,583 | A | 5/1977 | Gottlieb |
| 4,053,247 | A | 10/1977 | Marsh |
| 4,069,573 | A | 1/1978 | Rogers et al. |
| 4,076,287 | A | 2/1978 | Bill et al. |
| 4,096,913 | A | 6/1978 | Kenneday et al. |
| 4,098,334 | A | 7/1978 | Crowe |
| 4,125,937 | A | 11/1978 | Brown et al. |
| 4,152,821 | A | 5/1979 | Scott |
| 4,168,747 | A | 9/1979 | Youmans |
| 4,190,108 | A | 2/1980 | Webber |
| 4,205,422 | A | 6/1980 | Hardwick |
| 4,226,449 | A | 10/1980 | Cole |
| 4,253,687 | A | 3/1981 | Maples |
| 4,257,155 | A | 3/1981 | Hunter |
| 4,274,665 | A | 6/1981 | Marsh |
| RE30,802 | E | 11/1981 | Rogers |
| 4,304,428 | A | 12/1981 | Grigorian et al. |

4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart et al.
4,646,787 A 3/1987 Rush et al.
4,649,492 A 3/1987 Sinha et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson et al.
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges 5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet et al.
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,253,713 A 10/1993 Gregg et al.
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Baro et al.
5,370,425 A 12/1994 Dougherty et al.
5,375,661 A 12/1994 Daneshy et al.
5,388,648 A 2/1995 Jordan
5,390,735 A 2/1995 Williamson
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp 6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,275,556 B1 8/2001 Kinney et al.
6,283,211 B1 9/2001 Vloedman
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 * 2/2002 Chakradhar et al. ..... 714/738
6,345,431 B1 2/2002 Greig
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 * 3/2004 Harrall et al. ..... 166/382
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 * 4/2004 Vercaemer et al. ..... 166/308.1
6,722,443 B1 4/2004 Metcalfe
6,725,917 B2 * 4/2004 Metcalfe ..... 166/153
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,772,841 B2 * 8/2004 Gano ..... 166/313
6,796,380 B2 9/2004 Xu
6,814,147 B2 11/2004 Baugh
6,820,690 B2 * 11/2004 Vercaemer et al. ..... 166/277
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,892,819 B2 * 5/2005 Cook et al. ..... 166/380
6,902,000 B2 6/2005 Simpson et al.
6,902,652 B2 6/2005 Heijnen
2001/0002626 A1 6/2001 Frank et al.
2001/0020532 A1 9/2001 Baugh et al.

2001/0045284 A1 11/2001 Simpson et al.
2001/0045289 A1* 11/2001 Cook et al. ..... 166/380
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1* 3/2002 Metcalfe ..... 166/285
2002/0060068 A1* 5/2002 Cook et al. ..... 166/277
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Maguire
2003/0075338 A1 4/2003 Sivley
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1* 6/2003 Metcalfe ..... 166/285
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0168222 A1 9/2003 Maguire et al.
2003/0173090 A1 9/2003 Cook et al.
2003/0192705 A1 10/2003 Cook et al.
2003/0221841 A1* 12/2003 Burtner et al. ..... 166/380
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1* 8/2004 Haugen et al. ..... 166/384
2004/0188099 A1 9/2004 Cook et al.
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1* 3/2005 Luke et al. ..... 166/384
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217866 A1 10/2005 Watson et al.
2005/0269107 A1* 12/2005 Cook et al. ..... 166/384

FOREIGN PATENT DOCUMENTS

AU 770008 7/2004
AU 770359 7/2004
AU 771884 8/2004
AU 776580 1/2005
CA 736288 6/1966
CA 771462 11/1967
CA 1171310 7/1984
CA 2292171 6/2000
CA 2298139 8/2000
CA 2234386 3/2003
DE 203767 11/1963
DE 233607 A1 3/1966
DE 2458168 6/1975
DE 278517 A1 5/1990
EP 0084940 A1 8/1983
EP 0272511 12/1987
EP 0294264 5/1988
EP 0553566 A1 12/1992
EP 0633391 A2 1/1995
EP 0713953 B1 11/1995
EP 0823534 2/1998
EP 0881354 12/1998
EP 0881359 12/1998
EP 0899420 3/1999
EP 0937861 8/1999
EP 0952305 10/1999
EP 0952306 10/1999
EP 1141515 A 10/2001
EP 1152120 A2 11/2001
EP 1152120 A3 11/2001
EP 1235972 A 9/2002
EP 1555386 7/2005
FR 1325596 6/1962
FR 2717855 A1 9/1995
FR 2741907 A1 6/1997

| | | | |
|---|---|---|---|
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373534 | | 9/2002 |
| GB | 2367842 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |

| | | | |
|---|---|---|---|
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 24018393 | B | 7/2005 |
| GB | 2 403970 | B | 8/2005 |
| GB | 2398326 | B | 8/2005 |
| GB | 2403971 | B | 8/2005 |
| GB | 2403972 | B | 8/2005 |
| GB | 2412681 | A | 10/2005 |
| GB | 2412682 | A | 10/2005 |
| GB | 2408277 | A | 5/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1975 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853069 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |

| | | | |
|---|---|---|---|
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/039432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01//38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/058022 | A3 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/106130 | A2 | 12/2003 |
| WO | WO04/003337 | A1 | 1/2004 |
| WO | WO04/009950 | A1 | 1/2004 |
| WO | WO04/010039 | A2 | 1/2004 |
| WO | WO04/010039 | A3 | 1/2004 |
| WO | WO04/011776 | A2 | 2/2004 |
| WO | WO04/011776 | A3 | 2/2004 |
| WO | WO04/018823 | A2 | 3/2004 |
| WO | WO04/018823 | A3 | 3/2004 |
| WO | WO04/018824 | A2 | 3/2004 |
| WO | WO04/018824 | A3 | 3/2004 |
| WO | WO04/020895 | A2 | 3/2004 |
| WO | WO04/020895 | A3 | 3/2004 |
| WO | WO04/023014 | A2 | 3/2004 |
| WO | WO04/023014 | A3 | 3/2004 |
| WO | WO04/026017 | A2 | 4/2004 |
| WO | WO04/026017 | A3 | 4/2004 |
| WO | WO04/026073 | A2 | 4/2004 |
| WO | WO04/026073 | A3 | 4/2004 |
| WO | WO04/026500 | A2 | 4/2004 |
| WO | WO04/026500 | A3 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A2 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/057715 | A2 | 7/2004 |
| WO | WO04/057715 | A3 | 7/2004 |

| | | | |
|---|---|---|---|
| WO | WO04/067961 | A2 | 8/2004 |
| WO | WO04/067961 | A3 | 8/2004 |
| WO | WO04/072436 | A1 | 8/2004 |
| WO | WO04/074622 | A2 | 9/2004 |
| WO | WO04/074622 | A3 | 9/2004 |
| WO | WO04/076798 | A2 | 9/2004 |
| WO | WO04/076798 | A3 | 9/2004 |
| WO | WO04/081346 | A2 | 9/2004 |
| WO | WO04/083591 | A2 | 9/2004 |
| WO | WO04/083591 | A3 | 9/2004 |
| WO | WO04/083592 | A2 | 9/2004 |
| WO | WO04/083592 | A3 | 9/2004 |
| WO | WO04/083593 | A2 | 9/2004 |
| WO | WO04/083594 | A2 | 9/2004 |
| WO | WO04/083594 | A3 | 9/2004 |
| WO | WO04/085790 | A2 | 10/2004 |
| WO | WO04/089608 | A2 | 10/2004 |
| WO | WO04/092527 | A3 | 10/2004 |
| WO | WO04/092528 | A2 | 10/2004 |
| WO | WO04/092530 | A2 | 10/2004 |
| WO | WO04/092530 | A3 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021921 | A3 | 3/2005 |
| WO | WO05/021922 | A2 | 3/2005 |
| WO | WO05/021922 | A3 | 3/2005 |
| WO | WO05/024170 | A2 | 3/2005 |
| WO | WO05/024171 | A2 | 3/2005 |
| WO | WO05/028803 | A2 | 3/2005 |
| WO | WO05/071212 | A1 | 4/2005 |
| WO | WO05/081803 | A2 | 9/2005 |
| WO | WO05/086614 | A2 | 9/2005 |

OTHER PUBLICATIONS

Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.

Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including . . . " (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003..
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Search Report, Application PCT/US03/38550; Jun. 15, 2004.
Search and Examination Report to Application No. GB0004282.0, Jun. 3, 2003.
Search Report to Application No. GB 0004285.3, Jan. 19, 2001.
Examination Report to Application No. GB 0005399.1; Jul. 24, 2000.
Examination Report to Application No. GB 0005399.1; Oct. 14, 2002.
Examination Report to Application No. GB 0013661.4, Nov. 25, 2003.
Search Report to Application No. GB 0013661.4, Oct. 20, 2003.
Examination Report to Application No. GB 0208367.3, Nov. 4, 2003.
Examination Report to Application No. GB 0208367.3, Nov. 17, 2003.

Examination Report to Application No. GB 0208367.3, Jan. 30, 2004.
Examination Report to Application No. GB 0216409.3, Feb. 9, 2004.
Examination Report to Application No. GB 0219757.2, May 10, 2004.
Examination Report to Application No. GB 0300085.8, Nov. 28, 2003.
Examination Report to Application No. GB 030086.6, Dec. 1, 2003.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308303.7, Jul. 14, 2003.
Examination Report to Application No. GB 0311596.1, May 18, 2004.
Search and Examination Report to Application No. GB 0313406.1, Sep. 3, 2003.
Search and Examination Report to Application No. GB 0316883.8, Nov. 25, 2003.
Search and Examination Report to Application No. GB 0316886.1, Nov. 25, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2002.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search Report to Application No. GB 9926449.1, Jul. 4, 2001.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25727; May 17, 2004.
Written Opinion to Application No. PCT/US02/39418; Jun. 9, 2004.
Written Opinion to Application No. PCT/US03/11765 May 11, 2004.
International Examination Report, Application PCT/US02/24399, Aug. 6, 2004.
International Search Report, Application PCT/US03/20870; Sep. 30, 2004.
International Examination Report, Application PCT/US03/25676, Aug. 17, 2004.
International Examination Report, Application PCT/US03/25677, Aug. 17, 2004.
Examination Report to Application GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0314846.7, Jul. 15, 2004.
Examination Report to Application No. GB 0400018.8; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0404830.2, Aug. 17, 2004.

Search and Examination Report to Application No. GB 0411892.3, Jul. 14, 2004.
Search and Examination Report to Application No. GB 0411893.3, Jul. 14, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25727; May 17, 2004.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Letter From Baker Oil Tools to William Norvell in Regards to Enventure's Claims of Baker Infringement Of Enventure's Expandable Patents Apr. 1, 2005.
Offshore, "Agbada Well Solid Tubulars Expanded Bottom Up, Screens Expanded Top Down" William Furlow, Jan. 2002.(copy not available).
Drilling Contractor, "Solid Expandable Tubulars are Enabling Technology" Mar./Apr. 2001 .(copy not available).
Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, 3 Juillet 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultra-deepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct. 21, 2002.
World Oil, "Expandables and the Dream of the Monodiameter Well: A Status Report", Fischer, Perry. Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Prolific Gas Well and Minimizes loss of Production" Buckler Bill, et al., 2002.

Offshore Technology Conference, "Development and Field Testing of Solid Expandable Corrosion Resistant Cased-hole Liners to Boost Gas Production in Corrosive Environments" Siemers Gertjan, et al., 2003.
"Practices for Providing Zonal Isolation in Conjunction with Expandable Casing Jobs-Case Histories" Sanders, T. et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing " DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners- Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratilff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal—2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case history, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*. CD-ROM. May 2001.
International Examination Report, Application PCT/US02/25608; Jun. 1, 2005.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/06544, May 10, 2005.
International Examination Report, Application PCT/US03/11765; Dec. 10, 2004.
International Examination Report, Application PCT/US03/11765;; Jan. 25, 2005.
International Examination Report, Application PCT/US03/13787; Apr. 7, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Examination Report, Application PCT/US03/29858; May 23, 2005.

International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Examination Report to Application No. GB 0225505.7 Feb. 15, 2005.
Examination Report to Application No. GB 0314846.7, Jul. 15, 2004.
Search and Examination Report to Application No. GB 0400018.8; May 17, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Nov. 16, 2004.
Examination Report to Application No. GB 0422419.2 Dec. 8, 2004.
Search and Examination Report to Application No. GB 0422893.8 Nov. 24, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Arbuckle, "Advanced Laser Texturing Tames Tough Tasks," Metal Forming Magazine.
Brizmer et al., "A Laser Surface Textured Parallel Thrust Bearing," *Tribology Transactions*, 46(3):397-403, 2003.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
Etsion, "Improving Tribological Performance of Mechanical Seals by Laser Surface Texturing," *Surface Technologies*, LTD.
Etsion, "A Laser Surface Textured Hydrostatic Mechanical Seal," *Sealing Technology*, Mar. 2003.
"Expandable Sand Screens," *Weatherford Completion Systems*, 2002.
Fontova, "Solid Expandable Tubulars (SET) Provide Value to Operators Worldwide in a Variety of Applications," *EP Journal of Technology*, Apr. 2005.
Fraunhofer Iwu, "Research Area: Sheet Metal Forming—Superposition of Vibrations," 2001.
Gilmer et al., "World's First Completion Set Inside Expandable Screen," *High-Tech Wells*, 2003.
Guichelaar et al., "Effect of Micro-Surface Texturing on Breakaway Torque and Blister Formation on Carbon-Graphite Faces in a Mechanical Seal," *Lubrication Engineering*, Aug. 2002.

Haefke et al., "Microtexturing of Functional Surfaces for Improving Their Tribological Performance," *Proceedings of the International Tribology Conference*, 2000.
Halliburton Completion Products, 1996.
Linzell, "Trib-Gel A Chemical Cold Welding Agent,"1999.
Lizotte, "Scratching The Surface," *PT Design*, Jun. 19993.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Turcotte et al., "Geodynamics Applications of Continuum Physics to Geological Problems," 1982.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
www.JETLUBE.com, "Oilfield Catalog—Jet-Lok Product Applicatin Descriptions," 1998.
wwwo.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications—Spur Industries," 2000.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/20870, Sep. 30, 2004.
International Preliminary Examination Report, Application PCT/US03/25675, Aug. 30, 2005.
International Preliminary Examination Report, Application PCT/US03/25742, Dec. 20, 2004.
International Preliminary Examination Report, Application PCT/US03/38550, May 23, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Dec. 2, 2004.
Search Report to Application No. GB 0415835.8, Mar. 10, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0408672.4, Mar. 21, 2005.
Examination Report to Application No. GB 0411698.4, Jan. 24, 2005.
Examination Report to Application No. GB 0412533.2, May 20, 2005.
Examination Report to Application No. GB 0416834.0, Nov. 16, 2004.
Examination Report to Application No. GB 0500184.7, Sep. 12, 2005.
Examination Report to Application No. GB 0500600.2, Sep. 6, 2005.
Examination Report to Application No. GB 0507979.3, Jun. 16, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search Report to Application No. Norway 1999 5593, Aug. 20, 2002.

* cited by examiner

MONO-DIAMETER WELLBORE CASING

CROSS REFERENCE TO RELATED APPLICATIONS

This application is a continuation of international application No. PCTUS02/04353, filed Feb. 14, 2002 (status, abandoned, pending, etc.).

This application is the U.S. national stage utility patent application corresponding to PCT patent application serial number PCT/US02/04353, filed on Feb. 14, 2002, having a priority date of Feb. 20, 2001, and claims the benefit of the filing date of U.S. provisional patent application Ser. No. 60/270,007, filed on Feb. 20, 2001, the disclosures of which are incorporated herein by reference.

This application is a continuation-in-part of U.S. Pat. No. 6,497,289, which was filed as U.S. utility application Ser. No. 09/454,139, filed on Dec. 3, 1999, which claimed the benefit of the filing date of U.S. provisional patent application Ser. No. 60/111,293, filed on Dec. 7, 1998, the disclosures of which are incorporated herein by reference.

This application is related to the following: (1) U.S. Pat. No. 6,497,289, which was filed as U.S. patent application Ser. No. 09/454,139, filed on Dec. 3, 1999, (2) U.S. patent application Ser. No. 09/510,913, filed on Feb. 23, 2000, (3) U.S. Pat. No. 6,823,937, which was filed as U.S. patent application Ser. No. 09/502,350, filed on Feb. 10, 2000, (4) U.S. Pat. No. 6,328,113, U.S. patent application Ser. No. 09/440,338, filed on Nov. 15, 1999, (5) U.S. Pat. No. 6,640,903 which was filed as U.S. patent application Ser. No. 09/523,460, filed on Mar. 10, 2000, (6) U.S. Pat. No. 6,568,471, which was filed as U.S. patent application Ser. No. 09/512,895, filed on Feb. 24, 2000, (7) U.S. Pat. No. 6,575,240, which was filed as U.S. patent application Ser. No. 09/511,941, filed on Feb. 24, 2000, (8) U.S. Pat. No. 6,557,640, which was filed as U.S. patent application Ser. No. 09/588,946, filed on Jun. 7, 2000, (9) U.S. Pat. No. 6,604,763, which was filed as U.S. patent application Ser. No. 09/559,122, filed on Apr. 26, 2000, (10) U.S. patent application Ser. No. 10/030,593, filed on Jan. 8, 2002, which claims priority from PCT patent application Ser. No. PCT/US00/18635, filed on Jul. 9, 2000, (11) U.S. patent application Ser. No. 10/111,982, filed on Apr. 30, 2002, which claims priority from U.S. provisional patent application Ser. No. 60/162,671, filed on Nov. 1, 1999, (12) U.S. provisional patent application Ser. No. 60/154,047, filed on Sep. 16, 1999, (13) U.S. Pat. No. 6,564,875, which was filed as application Ser. No. 09/679,907, on Oct. 5, 2000, which claims priority from U.S. provisional patent application Ser. No. 60/159,082, filed on Oct. 12, 1999, (14) U.S. patent application Ser. No. 10/089,419, filed on Mar. 27, 2002, which claims priority from U.S. provisional patent application Ser. No. 60/159,039, filed on Oct. 12, 1999, (15) U.S. Pat. application Ser. No. 09/679,906, filed on Oct. 5, 2000, U.S. provisional patent application Ser. No. 60/159,033, filed on Oct. 12, 1999, (16) U.S. patent application Ser. No. 10/303,992, filed on Nov. 22, 2002, which claims priority from U.S. provisional patent application Ser. No. 60/212,359, filed on Jun. 19, 2000, (17) U.S. provisional patent application Ser. No. 60/165,228, filed on Nov. 12, 1999, (18) U.S. patent application Ser. No. 10/311,412, filed on Dec. 12, 2002, which claims priority from U.S. provisional patent application Ser. No. 60/221,443, filed on Jul. 28, 2000, (19) U.S. patent application Ser. No. 10/322,947, filed on Dec. 18, 2002, attorney docket no. 25791.46.07, which claims priority from U.S. provisional patent application Ser. No. 60/221,645, filed on Jul. 28, 2000, (20) U.S. patent application Ser. No. 10/322,947, filed on Jan. 22, 2003, which claims priority from U.S. provisional patent application Ser. No. 60/233,638, filed on Sep. 18, 2000, (21) U.S. patent application Ser. No. 10/406,648, filed on Mar. 31, 2003, which claims priority from U.S. provisional patent application Ser. No. 60/237,334, filed on Oct. 2, 2000, and (22) U.S. patent application Ser. No. 10/465,835, filed on Jun. 13, 2003, which claims priority from U.S. provisional patent application Ser. No. 60/262,434, filed on Jan. 17, 2001, the disclosures of which are incorporated herein by reference.

This application is related to the following applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application No. 60/121,702, filed on Feb. 25, 1999, (3) U.S. Pat. No. 6,823,937, which was filed as U.S. patent application Ser. No. 09/502,350, filed on Feb. 10, 2000, which claims priority from provisional application No. 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application No. 60/108,558, filed on Nov. 16, 1998, (5) U.S. patent application Ser. No. 10/169,434, filed on Jul. 1, 2002, which claims priority from provisional application No. 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application No. 60/124,042, filed on Mar. 11, 1999, (7) U.S. Pat. No. 6,568,471, which was filed as patent application Ser. No. 09/512,895, filed on Feb. 24, 2000, which claims priority from provisional application No. 60/121,841, filed on Feb. 26, 1999, (8) U.S. Pat. No. 6,575,240, which was filed as patent application Ser. No. 09/511,941, filed on Feb. 24, 2000, which claims priority from provisional application No. 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application No. 60/131,106, filed on Apr. 26, 1999, (12) U.S. patent application Ser. No. 10/030,593, filed on Jan. 8, 2002, which claims priority from provisional application No. 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Apr. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, attorney docket no. 25791.46.07, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application No. 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application No. 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application No. 60/111,293, filed on Dec. 7, 1998, (35) PCT Application US02/25608, filed on Aug. 13, 2002, which claims priority from provisional application No. 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (44) PCT application US02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application No. 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application No. 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application No. 60/121,841, filed on Feb.

26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application No. 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application No. 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application No. 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application No. 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application No. 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application No. 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application No. 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application No. 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S.

provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application No. 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application No. 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application No. 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application No. 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999; (122) PCT patent application Ser. No. POT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004; (131) PCT patent application Ser. No. PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, filed on Aug. 11, 2005, and (143). PCT patent application Ser. No. PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application Ser. No. 546,078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application Ser. No. PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application Ser. No. PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application Ser. No. 60/717,391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application Ser. No. 60/725,181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT Patent Application No. PCT/US2006/002449, filed on Jan. 20, 2006, (174) PCT Patent Application No. PCT/US2006/004809, filed on Feb. 9, 2006; (175) U.S. Utility Patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, and (188) U.S. utility patent application Ser. No. 10/950,869, filed on Sep. 27, 2004,

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming new sections of casing in a wellbore.

SUMMARY OF THE INVENTION

According to one aspect of the present invention, an apparatus for forming a wellbore casing in a borehole located in a subterranean formation including a preexisting wellbore casing is provided that includes a support member including a first fluid passage, an expansion cone coupled to the support member including a second fluid passage fluidicly coupled to the first fluid passage, an expandable tubular liner movably coupled to the expansion cone, and an expandable shoe coupled to the expandable tubular liner.

According to another aspect of the present invention, a shoe is provided that includes an upper annular portion, an intermediate annular portion, and a lower annular portion. The intermediate annular portion has an outer circumference that is larger than the outer circumferences of the upper and lower annular portions.

According to another aspect of the present invention, a method of forming a wellbore casing in a subterranean formation having a preexisting wellbore casing positioned in a borehole is provided that includes installing a tubular liner, an expansion cone, and a shoe in the borehole, radially expanding at least a portion of the shoe by injecting a fluidic material into the shoe, and radially expanding at least a portion of the tubular liner by injecting a fluidic material into the borehole below the expansion cone.

According to another aspect of the present invention, an apparatus for forming a wellbore casing in a subterranean formation having a preexisting wellbore casing positioned in a borehole is provided that includes means for installing a tubular liner, an expansion cone, and a shoe in the borehole, means for radially expanding at least a portion of the shoe, and means for radially expanding at least a portion of the tubular liner.

According to another aspect of the present invention, an apparatus for forming a wellbore casing within a subterranean formation including a preexisting wellbore casing positioned in a borehole is provided that includes a tubular liner, and means for radially expanding and coupling the tubular liner to an overlapping portion of the preexisting wellbore casing. The inside diameter of the radially expanded tubular liner is substantially equal to the inside diameter of a non-overlapping portion of the preexisting wellbore casing.

According to another aspect of the present invention, a wellbore casing positioned in a borehole within a subterranean formation is provided that includes a first wellbore casing, and a second wellbore casing coupled to and overlapping with the first wellbore casing. The second wellbore casing is coupled to the first wellbore casing by the process of: installing the second wellbore casing, an expansion cone, and a shoe in the borehole, radially expanding at least a portion of the shoe by injecting a fluidic material into the shoe, and radially expanding at least a portion of the second wellbore casing by injecting a fluidic material into the borehole below the expansion cone.

According to another aspect of the present invention, a method of forming a tubular structure in a subterranean formation having a preexisting tubular member positioned in a borehole is provided that includes installing a tubular liner, an expansion cone, and a shoe in the borehole, radially expanding at least a portion of the shoe by injecting a fluidic material into the shoe, and radially expanding at least a portion of the tubular liner by injecting a fluidic material into the borehole below the expansion cone.

According to another aspect of the present invention, an apparatus for forming a tubular structure in a subterranean formation having a preexisting tubular member positioned in a borehole is provided that includes means for installing a tubular liner, an expansion cone, and a shoe in the borehole, means for radially expanding at least a portion of the shoe, and means for radially expanding at least a portion of the tubular liner.

According to another aspect of the present invention, an apparatus for forming a tubular structure within a subterranean formation including a preexisting tubular member positioned in a borehole is provided that includes a tubular liner and means for radially expanding and coupling the tubular liner to an overlapping portion of the preexisting tubular member. The inside diameter of the radially expanded tubular liner is substantially equal to the inside diameter of a non-overlapping portion of the preexisting tubular member.

According to another aspect of the present invention, a tubular structure positioned in a borehole within a subterranean formation is provided that includes a first tubular member and a second tubular member coupled to and overlapping with the first tubular member. The second tubular member is coupled to the first tubular member by the process of: installing the second tubular member, an expansion cone, and a shoe in the borehole, radially expanding at least a portion of the shoe by injecting a fluidic material into the shoe, and radially expanding at least a portion of the second tubular member by injecting a fluidic material into the borehole below the expansion cone.

DETAILED DESCRIPTION OF THE ILLUSTRATIVE EMBODIMENTS

Figure 1:
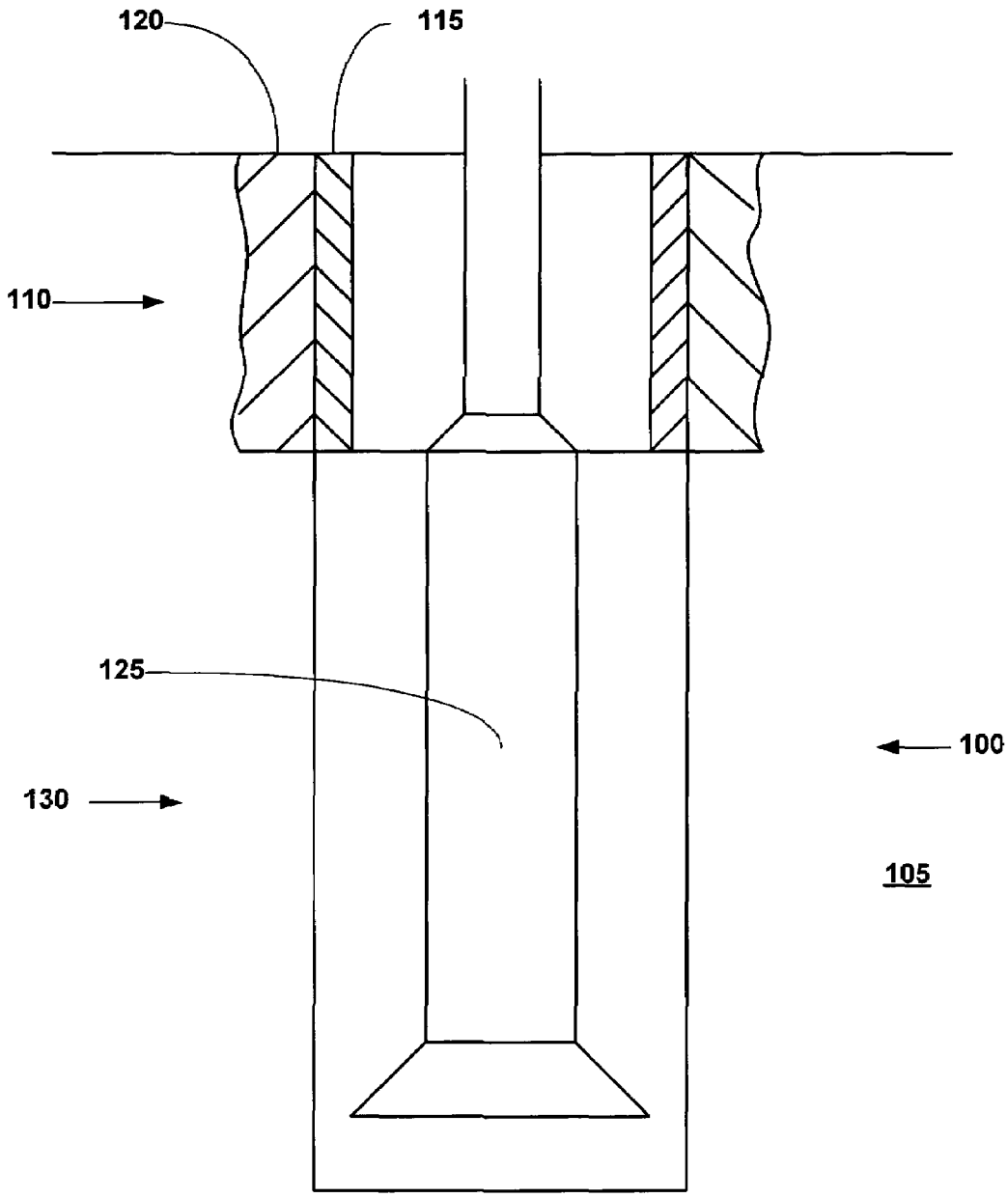
FIG. 1 is a fragmentary cross-sectional view illustrating the drilling of a new section of a well borehole.

Referring initially to FIGS. 1, 2, 2*a*, 2*b*, 2*c*, 2*d*, 2*e*, 3, 3*a*, 3*b*, 4, 4*a*, 4*b*, and 5–10, an embodiment of an apparatus and method for forming a mono-diameter wellbore casing within a subterranean formation will now be described. As illustrated in FIG. 1, a wellbore 100 is positioned in a subterranean formation 105. The wellbore 100 includes a pre-existing cased section 110 having a tubular casing 115 and an annular outer layer 120 of a fluidic sealing material such as, for example, cement. The wellbore 100 may be positioned in any orientation from vertical to horizontal. In several alternative embodiments, the pre-existing cased section 110 does not include the annular outer layer 120.

In order to extend the wellbore 100 into the subterranean formation 105, a drill string 125 is used in a well known manner to drill out material from the subterranean formation 105 to form a new wellbore section 130. In a preferred embodiment, the inside diameter of the new wellbore section 130 is greater than the inside diameter of the preexisting wellbore casing 115.

As illustrated in FIGS. 2, 2*a*, 2*b*, 2*c*, 2*d*, and 2*e*, an apparatus 200 for forming a wellbore casing in a subterranean formation is then positioned in the new section 130 of the wellbore 100. The apparatus 200 preferably includes an expansion cone 205 having a fluid passage 205*a* that supports a tubular member 210 that includes a lower portion 210*a*, an intermediate portion 210*b*, an upper portion 210*c*, and an upper end portion 210*d*.

The expansion cone 205 may be any number of conventional commercially available expansion cones. In several alternative embodiments, the expansion cone 205 may be controllably expandable in the radial direction, for example, as disclosed in U.S. Pat. No. 5,348,095, and/or 6,012,523, the disclosures of which are incorporated herein by reference.

The tubular member 210 may be fabricated from any number of conventional commercially available materials such as, for example, Oilfield Country Tubular Goods (OCTG), 13 chromium steel tubing/casing, or plastic tubing/casing. In a preferred embodiment, the tubular member 210 is fabricated from OCTG in order to maximize strength after expansion. In several alternative embodiments, the tubular member 210 may be solid and/or slotted. For typical tubular member 210 materials, the length of the tubular member 210 is preferably limited to between about 40 to 20,000 feet in length.

The lower portion 210*a* of the tubular member 210 preferably has a larger inside diameter than the upper portion 210*c* of the tubular member. In a preferred embodiment, the wall thickness of the intermediate portion 210*b* of the tubular member 201 is less than the wall thickness of the upper portion 210*c* of the tubular member in order to faciliate the initiation of the radial expansion process. In a preferred embodiment, the upper end portion 210*d* of the tubular member 210 is slotted, perforated, or otherwise modified to catch or slow down the expansion cone 205 when it completes the extrusion of tubular member 210. In a preferred embodiment, wall thickness of the upper end portion 210*d* of the tubular member 210 is gradually tapered in order to gradually reduce the required radial expansion forces during the latter stages of the radial expansion process. In this manner, shock loading conditions during the latter stages of the radial expansion process are at least minimized.

A shoe 215 is coupled to the lower portion 210*a* of the tubular member. The shoe 215 includes an upper portion 215*a*, an intermediate portion 215*b*, and lower portion 215*c* having a valveable fluid passage 220 that is preferably adapted to receive a plug, dart, or other similar element for controllably sealing the fluid passage 220. In this manner, the fluid passage 220 may be optimally sealed off by introducing a plug, dart and/or ball sealing elements into the fluid passage 220.

The upper and lower portions, 215*a* and 215*c*, of the shoe 215 are preferably substantially tubular, and the intermediate portion 215*b* of the shoe is preferably at least partially folded inwardly. Furthermore, in a preferred embodiment, when the intermediate portion 215*b* of the shoe 215 is unfolded by the application of fluid pressure to the interior region 230 of the shoe, the inside and outside diameters of the intermediate portion are preferably both greater than the inside and outside diameters of the upper and lower portions, 215*a* and 215*c*. In this manner, the outer circumference of the intermediate portion 215*b* of the shoe 215 is preferably greater than the outside circumferences of the upper and lower portions, 215*a* and 215*b*, of the shoe.

In a preferred embodiment, the shoe 215 further includes one or more through and side outlet ports in fluidic communication with the fluid passage 220. In this manner, the shoe 215 optimally injects hardenable fluidic sealing material into the region outside the shoe 215 and tubular member 210.

In an alternative embodiment, the flow passage 220 is omitted.

A support member 225 having fluid passages 225*a* and 225*b* is coupled to the expansion cone 205 for supporting the apparatus 200. The fluid passage 225*a* is preferably fluidicly coupled to the fluid passage 205*a*. In this manner, fluidic materials may be conveyed to and from the region 230 below the expansion cone 205 and above the bottom of the shoe 215. The fluid passage 225*b* is preferably fluidicly coupled to the fluid passage 225*a* and includes a conventional control valve. In this manner, during placement of the apparatus 200 within the wellbore 100, surge pressures can be relieved by the fluid passage 225*b*. In a preferred embodiment, the support member 225 further includes one or more conventional centralizers (not illustrated) to help stabilize the apparatus 200.

During placement of the apparatus 200 within the wellbore 100, the fluid passage 225*a* is preferably selected to transport materials such as, for example, drilling mud or formation fluids at flow rates and pressures ranging from about 0 to 3,000 gallons/minute and 0 to 9,000 psi in order to minimize drag on the tubular member being run and to minimize surge pressures exerted on the wellbore 130 which could cause a loss of wellbore fluids and lead to hole collapse. During placement of the apparatus 200 within the wellbore 100, the fluid passage 225*b* is preferably selected to convey fluidic materials at flow rates and pressures ranging from about 0 to 3,000 gallons/minute and 0 to 9,000 psi in order to reduce the drag on the apparatus 200 during insertion into the new section 130 of the wellbore 100 and to minimize surge pressures on the new wellbore section 130.

A cup seal 235 is coupled to and supported by the support member 225. The cup seal 235 prevents foreign materials from entering the interior region of the tubular member 210 adjacent to the expansion cone 205. The cup seal 235 may be any number of conventional commercially available cup seals such as, for example, TP cups, or Selective Injection Packer (SIP) cups modified in accordance with the teachings of the present disclosure. In a preferred embodiment, the cup seal 235 is a SIP cup seal, available from Halliburton Energy Services in Dallas, Tex. in order to optimally block foreign material and contain a body of lubricant. In several alternative embodiments, the cup seal 235 may include a plurality of cup seals.

One or more sealing members 240 are preferably coupled to and supported by the exterior surface of the upper end portion 210*d* of the tubular member 210. The sealing members 240 preferably provide an overlapping joint between the lower end portion 115*a* of the casing 115 and the upper end portion 210*d* of the tubular member 210. The sealing members 240 may be any number of conventional commercially available seals such as, for example, lead, rubber, Teflon, or epoxy seals modified in accordance with the teachings of the present disclosure. In a preferred embodiment, the sealing members 240 are molded from Stratalock epoxy available from Halliburton Energy Services in Dallas, Tex. in order to optimally provide a load bearing interference fit between the upper end portion 210*d* of the tubular member 210 and the lower end portion 115*a* of the existing casing 115.

In a preferred embodiment, the sealing members 240 are selected to optimally provide a sufficient frictional force to support the expanded tubular member 210 from the existing casing 115. In a preferred embodiment, the frictional force optimally provided by the sealing members 240 ranges from about 1,000 to 1,000,000 lbf in order to optimally support the expanded tubular member 210.

In an alternative embodiment, the sealing members 240 are omitted from the upper end portion 210*d* of the tubular member 210, and a load bearing metal-to-metal interference fit is provided between upper end portion of the tubular member and the lower end portion 115*a* of the existing casing 115 by plastically deforming and radially expanding the tubular member into contact with the existing casing.

In a preferred embodiment, a quantity of lubricant 245 is provided in the annular region above the expansion cone 205 within the interior of the tubular member 210. In this manner, the extrusion of the tubular member 210 off of the expansion cone 205 is facilitated. The lubricant 245 may be any number of conventional commercially available lubricants such as, for example, Lubriplate, chlorine based lubricants, oil based lubricants or Climax 1500 Antisieze (3100). In a preferred embodiment, the lubricant 245 is Climax 1500 Antisieze (3100) available from Climax Lubricants and Equipment Co. in Houston, Tex. in order to optimally provide optimum lubrication to faciliate the expansion process.

In a preferred embodiment, the support member 225 is thoroughly cleaned prior to assembly to the remaining portions of the apparatus 200. In this manner, the introduction of foreign material into the apparatus 200 is minimized. This minimizes the possibility of foreign material clogging the various flow passages and valves of the apparatus 200.

In a preferred embodiment, before or after positioning the apparatus 200 within the new section 130 of the wellbore 100, a couple of wellbore volumes are circulated in order to ensure that no foreign materials are located within the wellbore 100 that might clog up the various flow passages and valves of the apparatus 200 and to ensure that no foreign material interferes with the expansion process.

Figure 2:
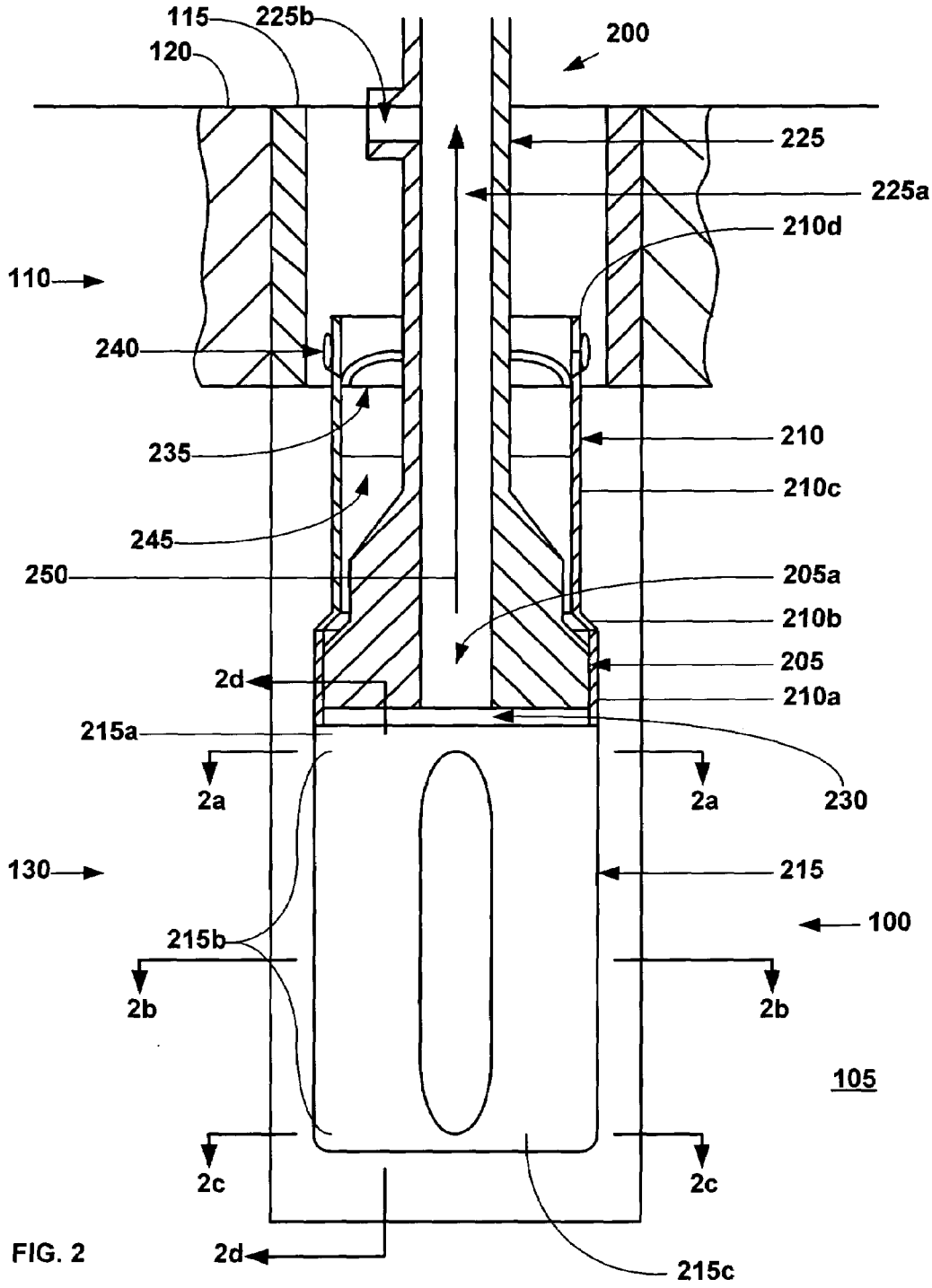
FIG. 2 is a fragmentary cross-sectional view illustrating the placement of an embodiment of an apparatus for creating a mono-diameter wellbore casing within the new section of the well borehole of FIG. 1.
Figure 2A:
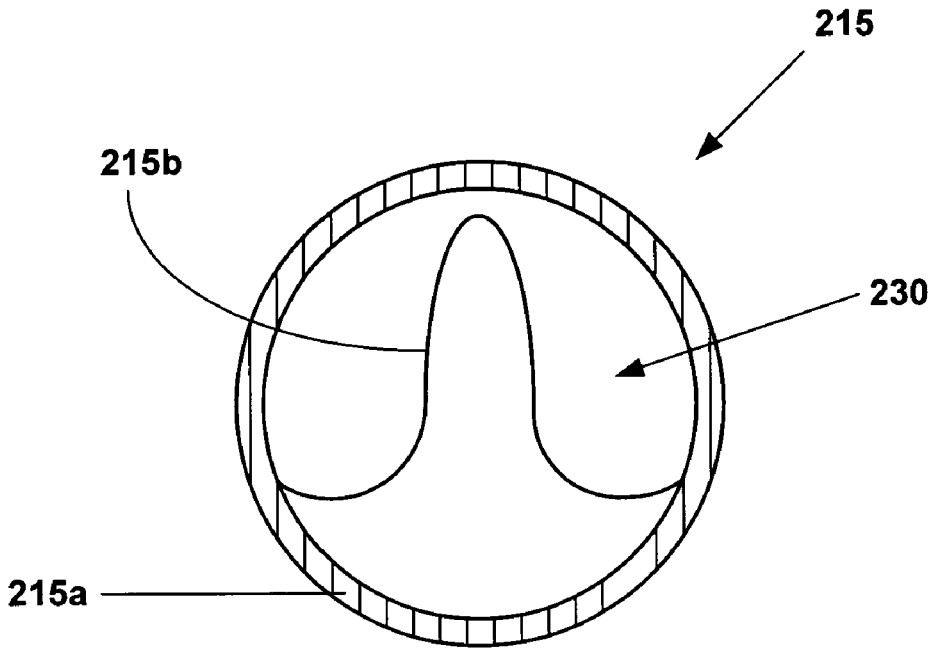
FIG. 2*a* is a cross-sectional view of a portion of the shoe of the apparatus of FIG. 2.
Figure 2B:
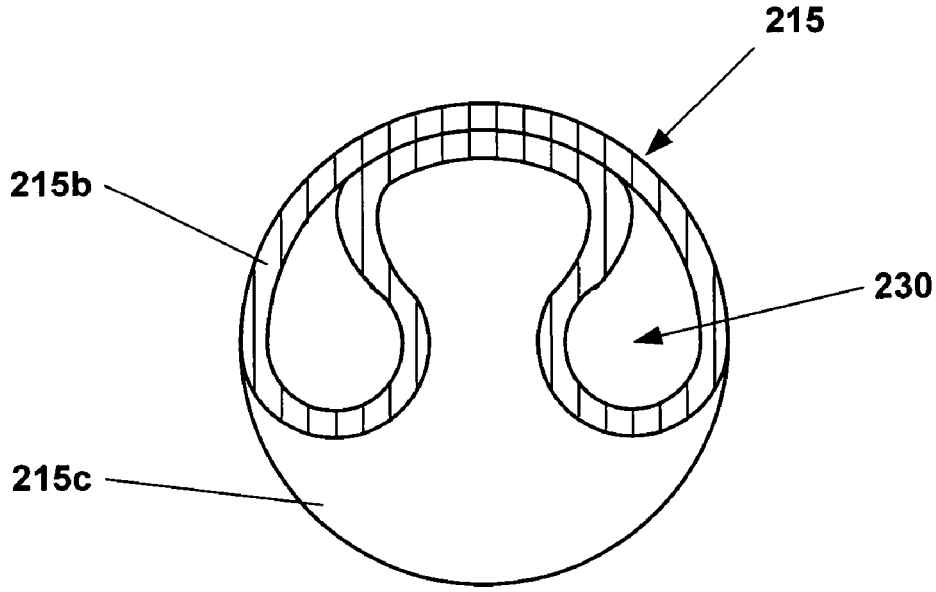
FIG. 2*b* is a cross-sectional view of another portion of the shoe of the apparatus of FIG. 2.
Figure 2C:
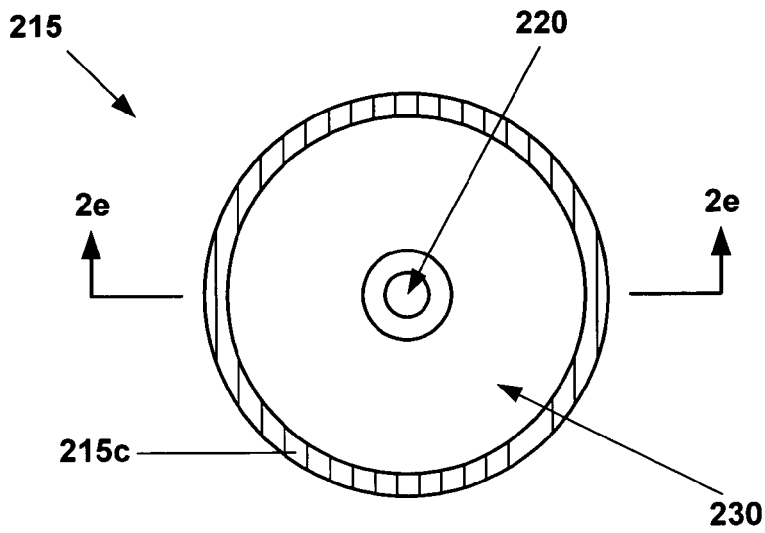
FIG. 2*c* is a cross-sectional view of another portion of the shoe of the apparatus of FIG. 2.
Figure 2D:
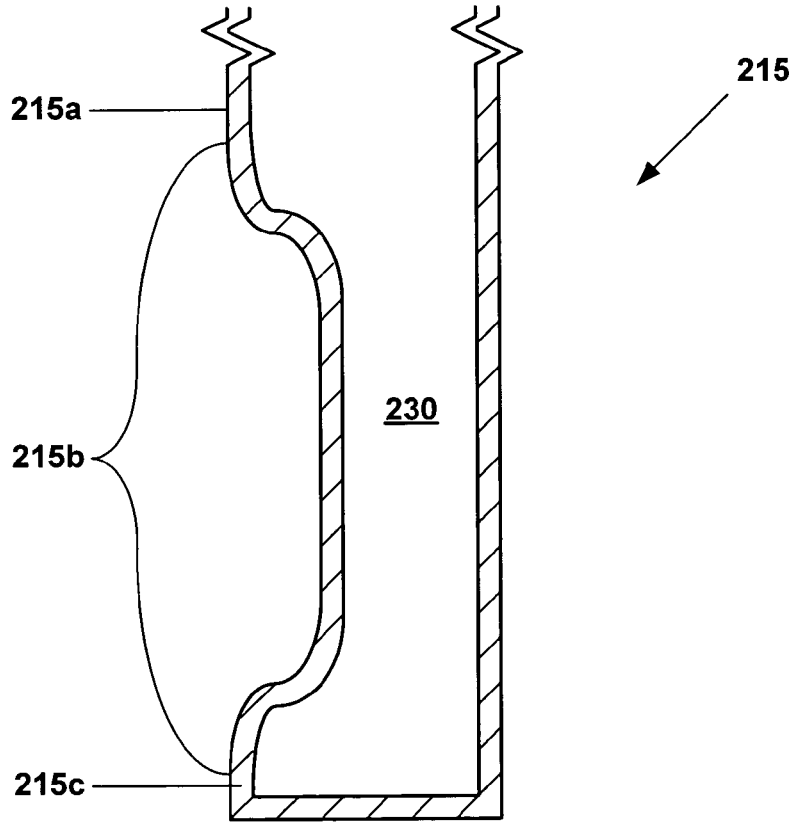
FIG. 2*d* is a cross-sectional view of another portion of the shoe of the apparatus of FIG. 2.
Figure 2E:
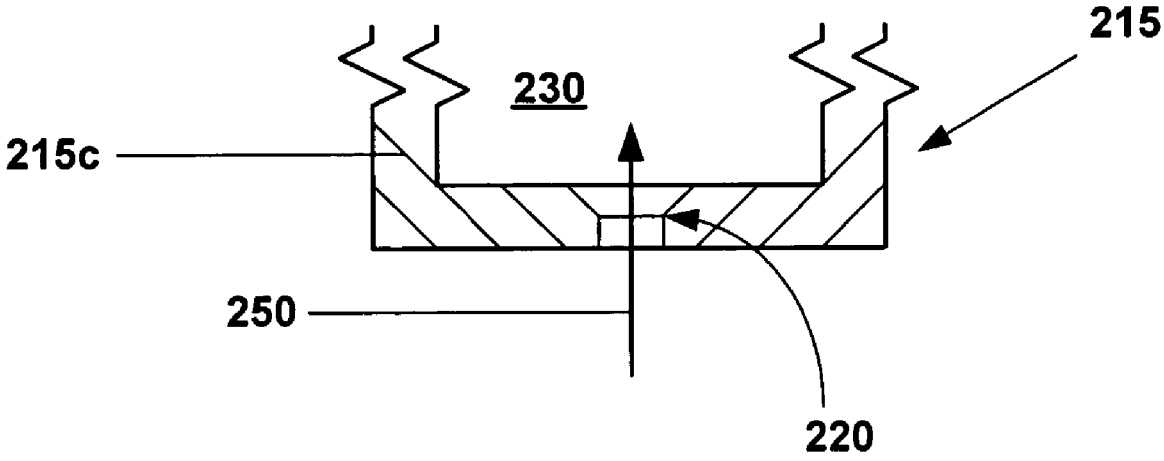
FIG. 2*e* is a cross-sectional view of a portion of the shoe of the apparatus of FIG. 2*c*.

As illustrated in FIGS. 2 and 2*e*, in a preferred embodiment, during placement of the apparatus 200 within the wellbore 100, fluidic materials 250 within the wellbore that are displaced by the apparatus are at least partially conveyed through the fluid passages 220, 205*a*, 225*a*, and 225*b*. In this manner, surge pressures created by the placement of the apparatus within the wellbore 100 are reduced.

Figure 3:
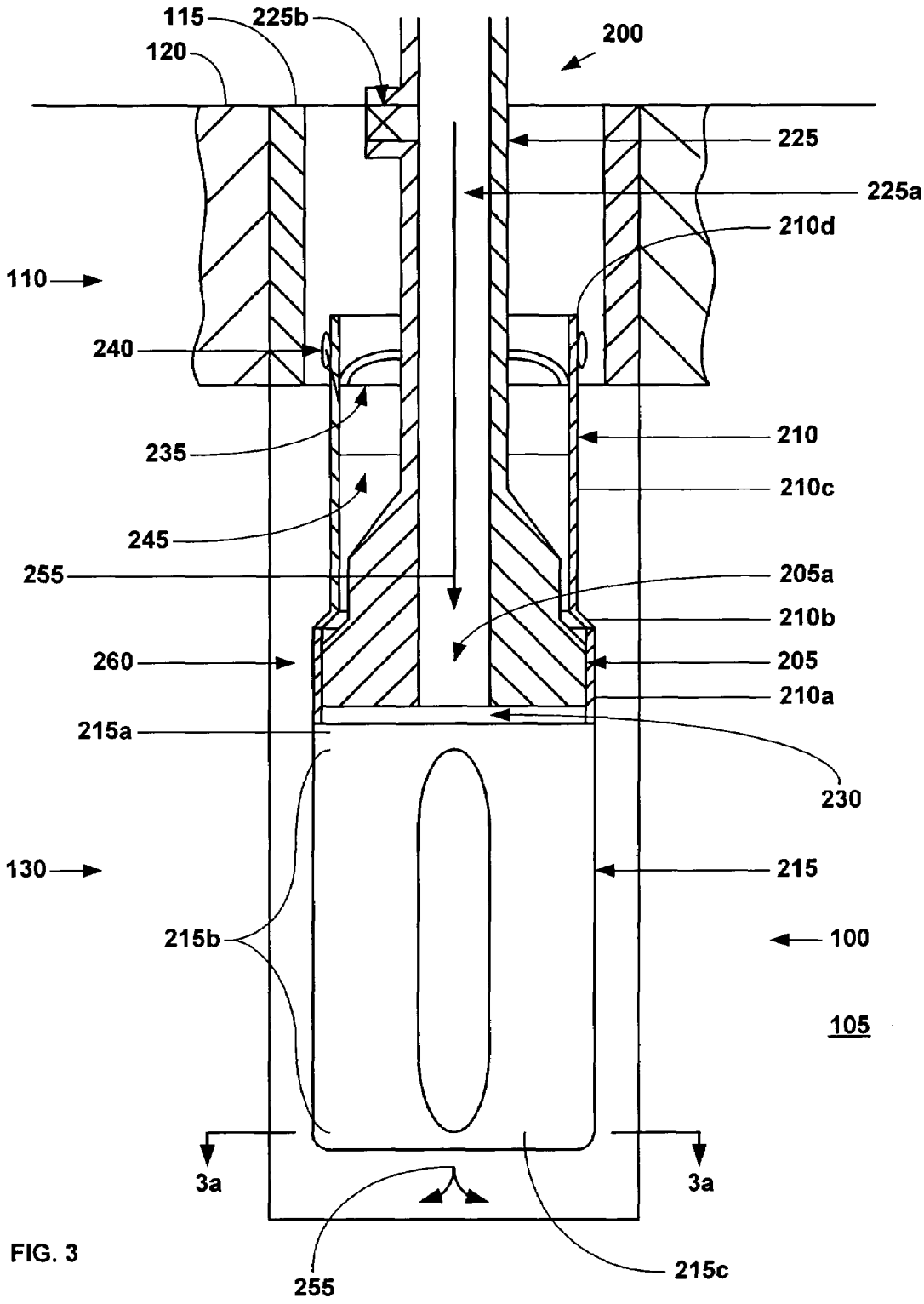
FIG. 3 is a fragmentary cross-sectional view illustrating the injection of a hardenable fluidic sealing material through the apparatus and into the new section of the well borehole of FIG. 2.
Figure 3A:
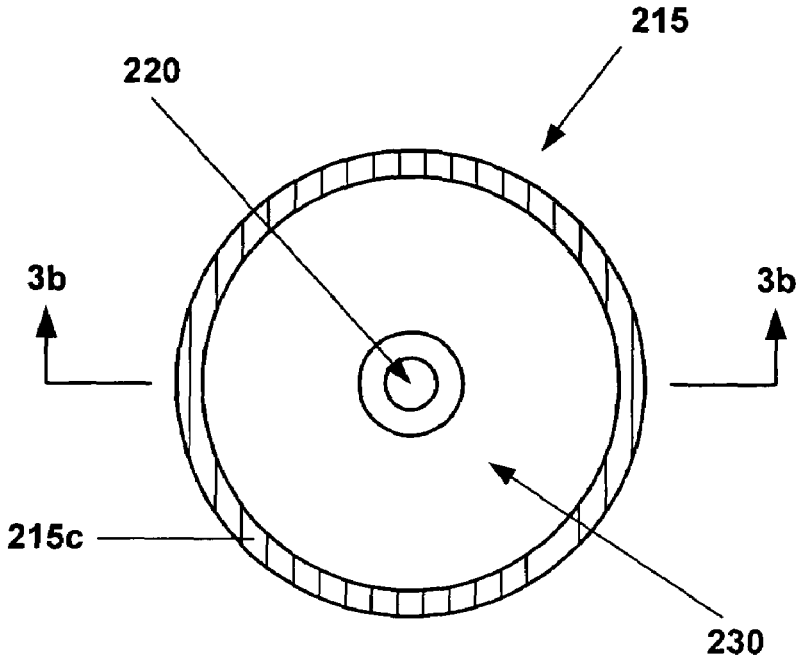
FIG. 3*a* is a cross-sectional view of a portion of the shoe of the apparatus of FIG. 3.
Figure 3B:
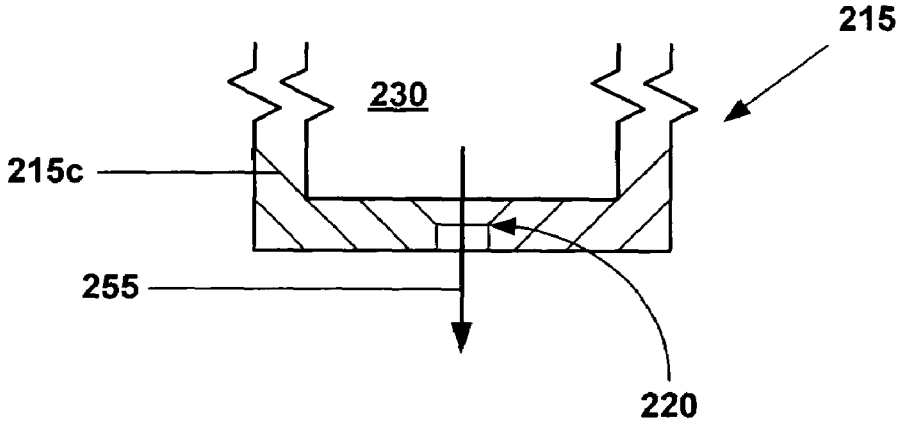
FIG. 3*b* is a cross-sectional view of a portion of the shoe of the apparatus of FIG. 3*a*.

As illustrated in FIGS. 3, 3*a*, and 3*b*, the fluid passage 225*b* is then closed and a hardenable fluidic sealing material 255 is then pumped from a surface location into the fluid passages 225*a* and 205*a*. The material 255 then passes from the fluid passage 205*a* into the interior region 230 of the shoe 215 below the expansion cone 205. The material 255 then passes from the interior region 230 into the fluid passage 220. The material 255 then exits the apparatus 200 and fills an annular region 260 between the exterior of the tubular member 210 and the interior wall of the new section 130 of the wellbore 100. Continued pumping of the material 255 causes the material to fill up at least a portion of the annular region 260.

The material 255 is preferably pumped into the annular region 260 at pressures and flow rates ranging, for example, from about 0 to 5000 psi and 0 to 1,500 gallons/min, respectively. The optimum flow rate and operating pressures vary as a function of the casing and wellbore sizes, wellbore section length, available pumping equipment, and fluid properties of the fluidic material being pumped. The optimum flow rate and operating pressure are preferably determined using conventional empirical methods.

The hardenable fluidic sealing material 255 may be any number of conventional commercially available hardenable fluidic sealing materials such as, for example, slag mix, cement, latex or epoxy. In a preferred embodiment, the hardenable fluidic sealing material 255 is a blended cement prepared specifically for the particular well section being drilled from Halliburton Energy Services in Dallas, Tex. in order to provide optimal support for tubular member 210 while also maintaining optimum flow characteristics so as to minimize difficulties during the displacement of cement in the annular region 260. The optimum blend of the blended cement is preferably determined using conventional empirical methods. In several alternative embodiments, the hardenable fluidic sealing material 255 is compressible before, during, or after curing.

The annular region 260 preferably is filled with the material 255 in sufficient quantities to ensure that, upon radial expansion of the tubular member 210, the annular region 260 of the new section 130 of the wellbore 100 will be filled with the material 255.

In an alternative embodiment, the injection of the material 255 into the annular region 260 is omitted, or is provided after the radial expansion of the tubular member 210.

Figure 4:
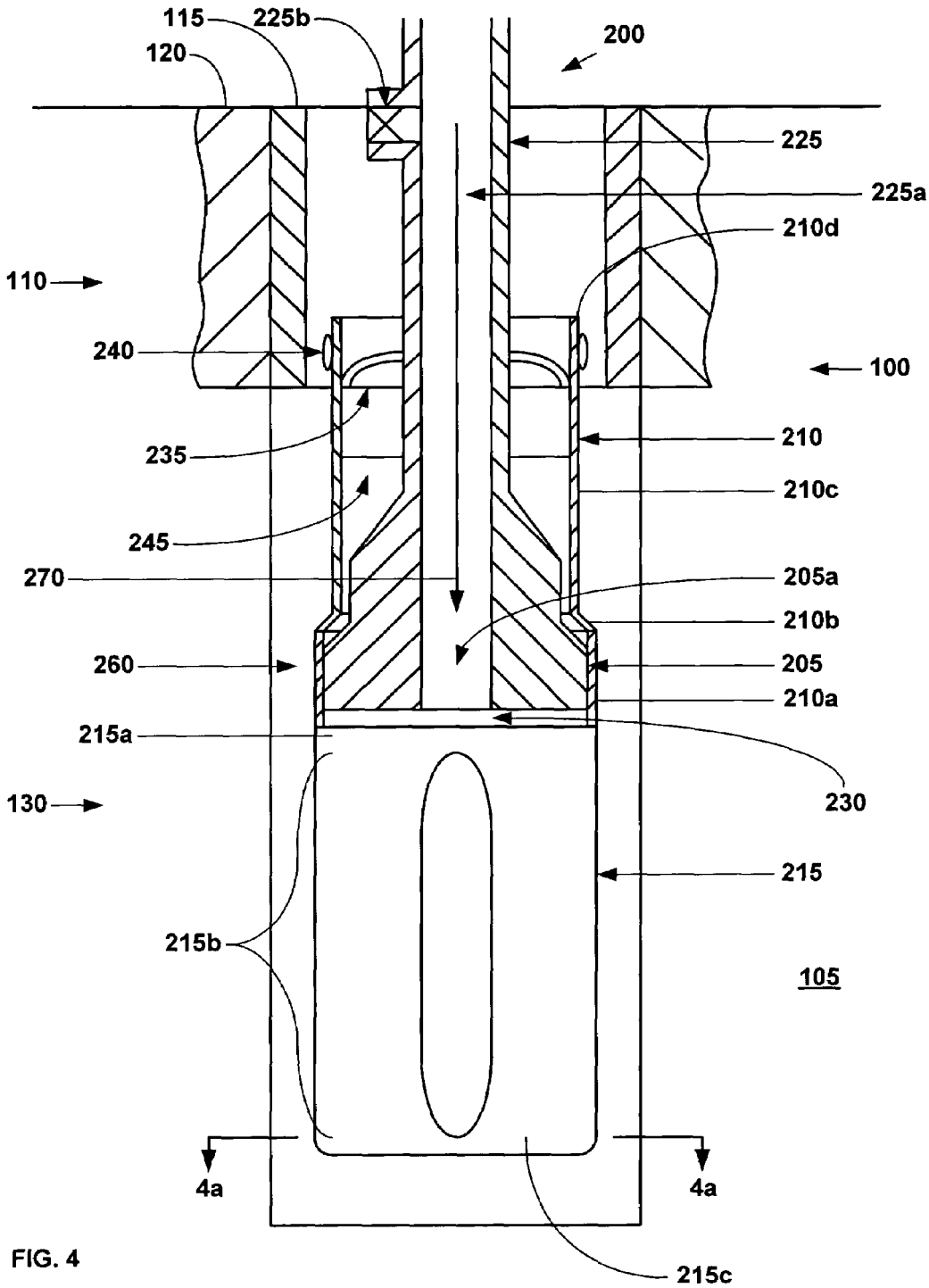
FIG. 4 is a fragmentary cross-sectional view illustrating the injection of a fluidic material into the apparatus of FIG. 3 in order to fluidicly isolate the interior of the shoe.\
Figure 4A:
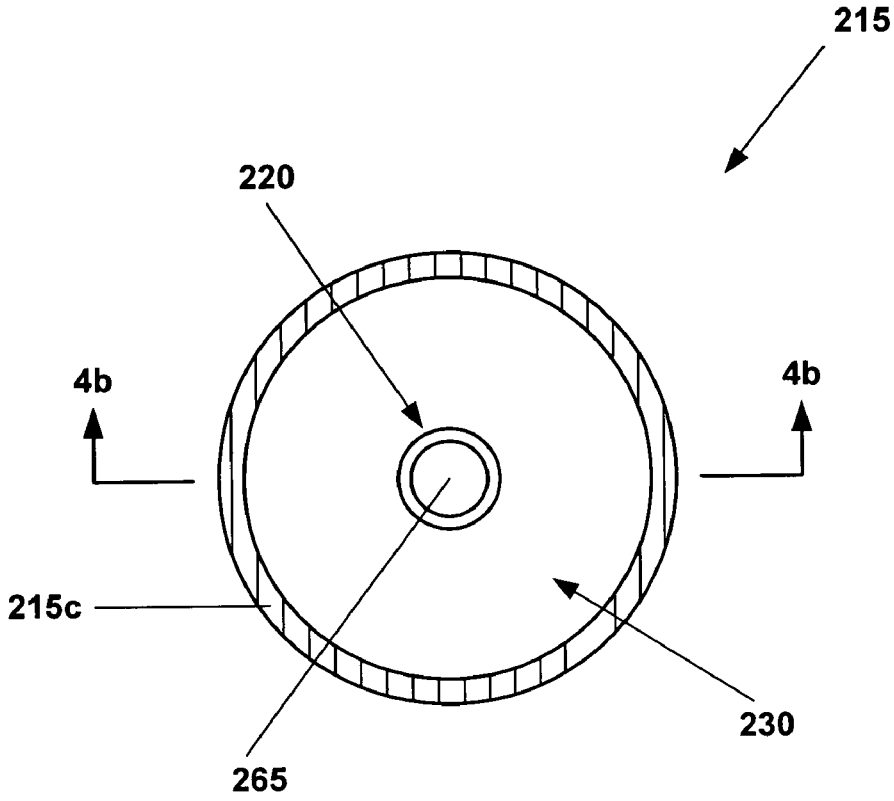
FIG. 4*a* is a cross-sectional view of a portion of the shoe of the apparatus of FIG. 4.
Figure 4B:
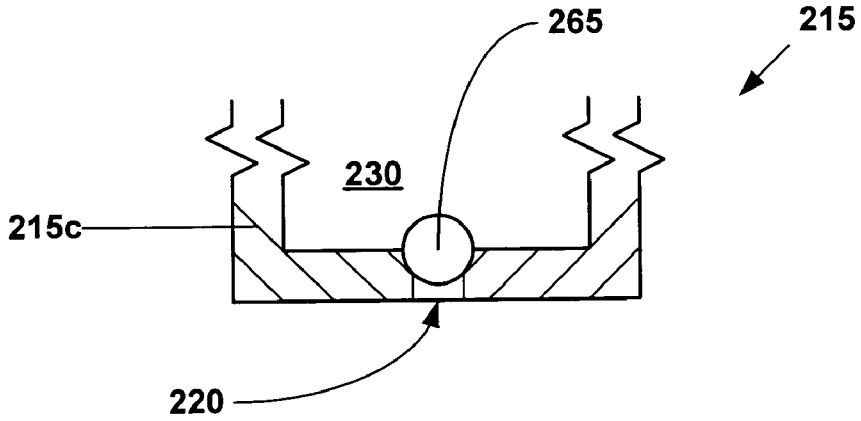
FIG. 4*b* is a cross-sectional view of a portion of the shoe of the apparatus of FIG. 4*a*.

As illustrated in FIGS. 4, 4*a*, and 4*b*, once the annular region 260 has been adequately filled with the material 255, a plug 265, or other similar device, is introduced into the fluid passage 220, thereby fluidicly isolating the interior region 230 from the annular region 260. In a preferred embodiment, a non-hardenable fluidic material 270 is then pumped into the interior region 230 causing the interior region to pressurize. In this manner, the interior region 230 of the expanded tubular member 210 will not contain significant amounts of the cured material 255. This also reduces and simplifies the cost of the entire process. Alternatively, the material 255 may be used during this phase of the process.

Figure 5:
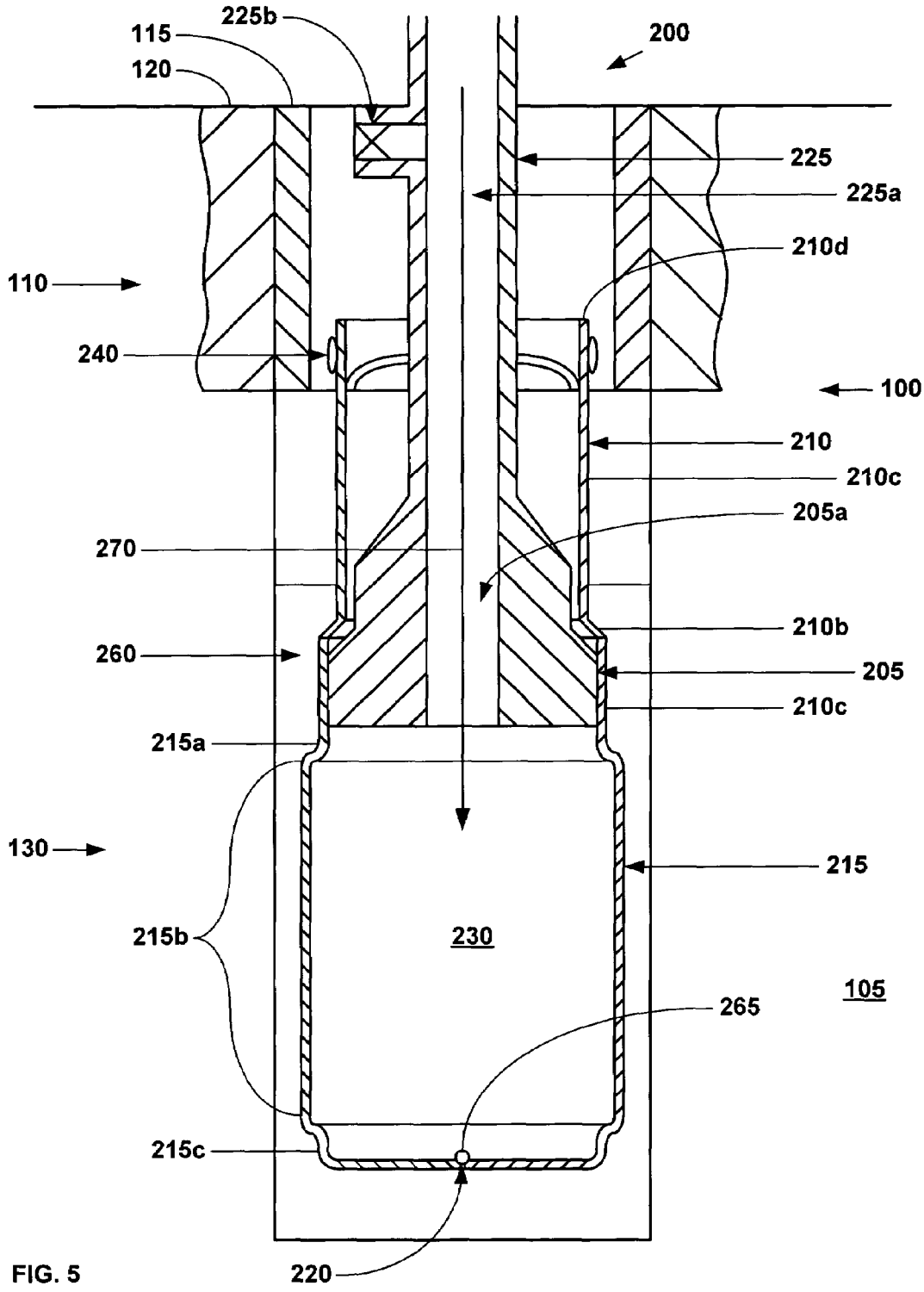
FIG. 5 is a cross-sectional view illustrating the radial expansion of the shoe of FIG. 4.

As illustrated in FIG. 5, in a preferred embodiment, the continued injection of the fluidic material 270 pressurizes the region 230 and unfolds the intermediate portion 215*b* of the shoe 215. In a preferred embodiment, the outside diameter of the unfolded intermediate portion 215*b* of the shoe 215 is greater than the outside diameter of the upper and lower portions, 215*a* and 215*b*, of the shoe. In a preferred embodiment, the inside and outside diameters of the unfolded intermediate portion 215*b* of the shoe 215 are greater than the inside and outside diameters, respectively, of the upper and lower portions, 215*a* and 215*b*, of the shoe. In a preferred embodiment, the inside diameter of the unfolded intermediate portion 215*b* of the shoe 215 is substantially equal to or greater than the inside diameter of the preexisting casing 115 in order to optimally facilitate the formation of a mono-diameter wellbore casing.

Figure 6:
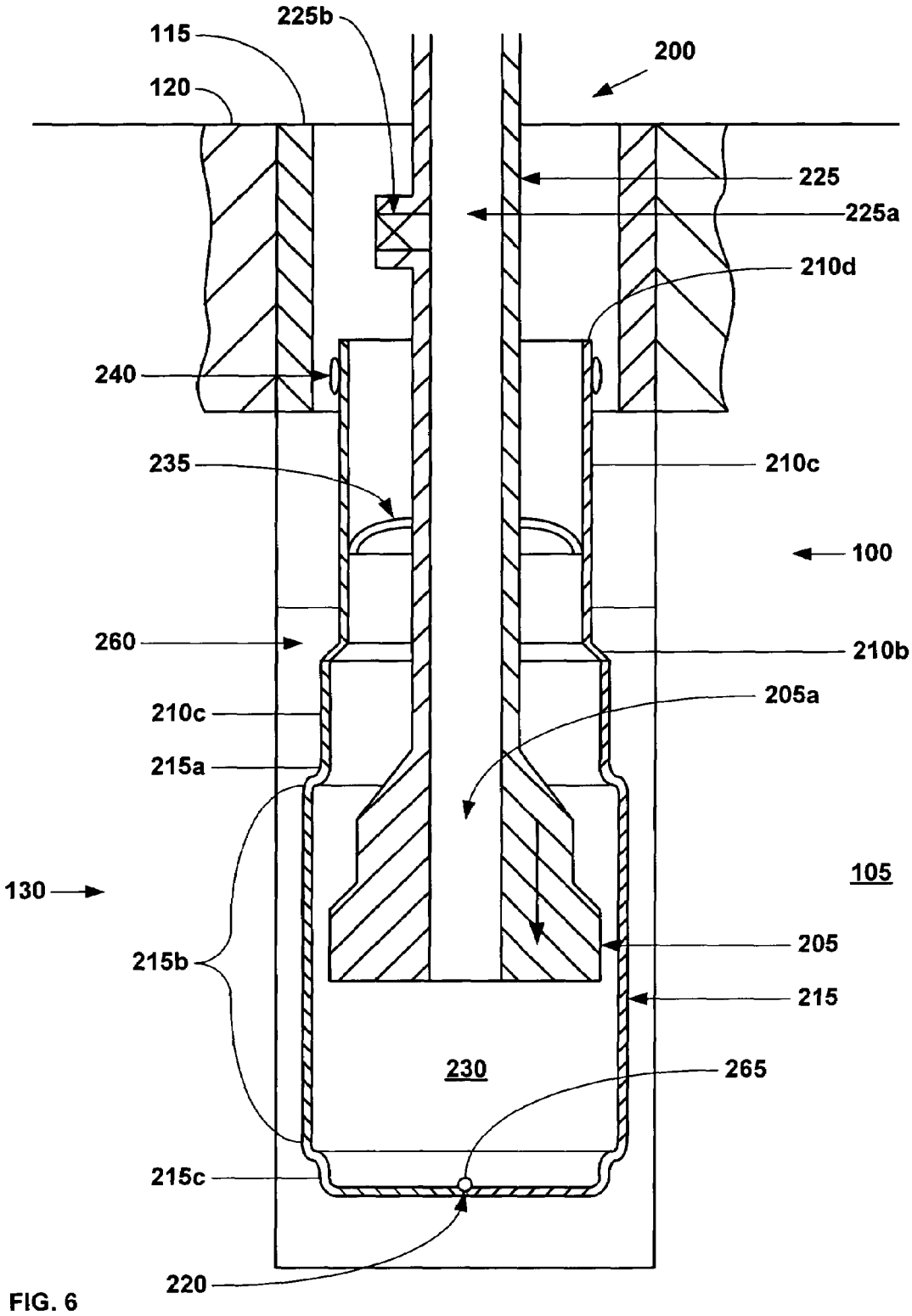
FIG. 6 is a cross-sectional view illustrating the lowering of the expandable expansion cone into the radially expanded shoe of the apparatus of FIG. 5.

As illustrated in FIG. 6, in a preferred embodiment, the expansion cone 205 is then lowered into the unfolded intermediate portion 215*b* of the shoe 215. In a preferred embodiment, the expansion cone 205 is lowered into the unfolded intermediate portion 215*b* of the shoe 215 until the bottom of the expansion cone is proximate the lower portion 215*c* of the shoe 215. In a preferred embodiment, during the lowering of the expansion cone 205 into the unfolded intermediate portion 215*b* of the shoe 215, the material 255 within the annular region 260 and/or the bottom of the wellbore section 130 maintains the shoe 215 in a substantially stationary position.

Figure 7:
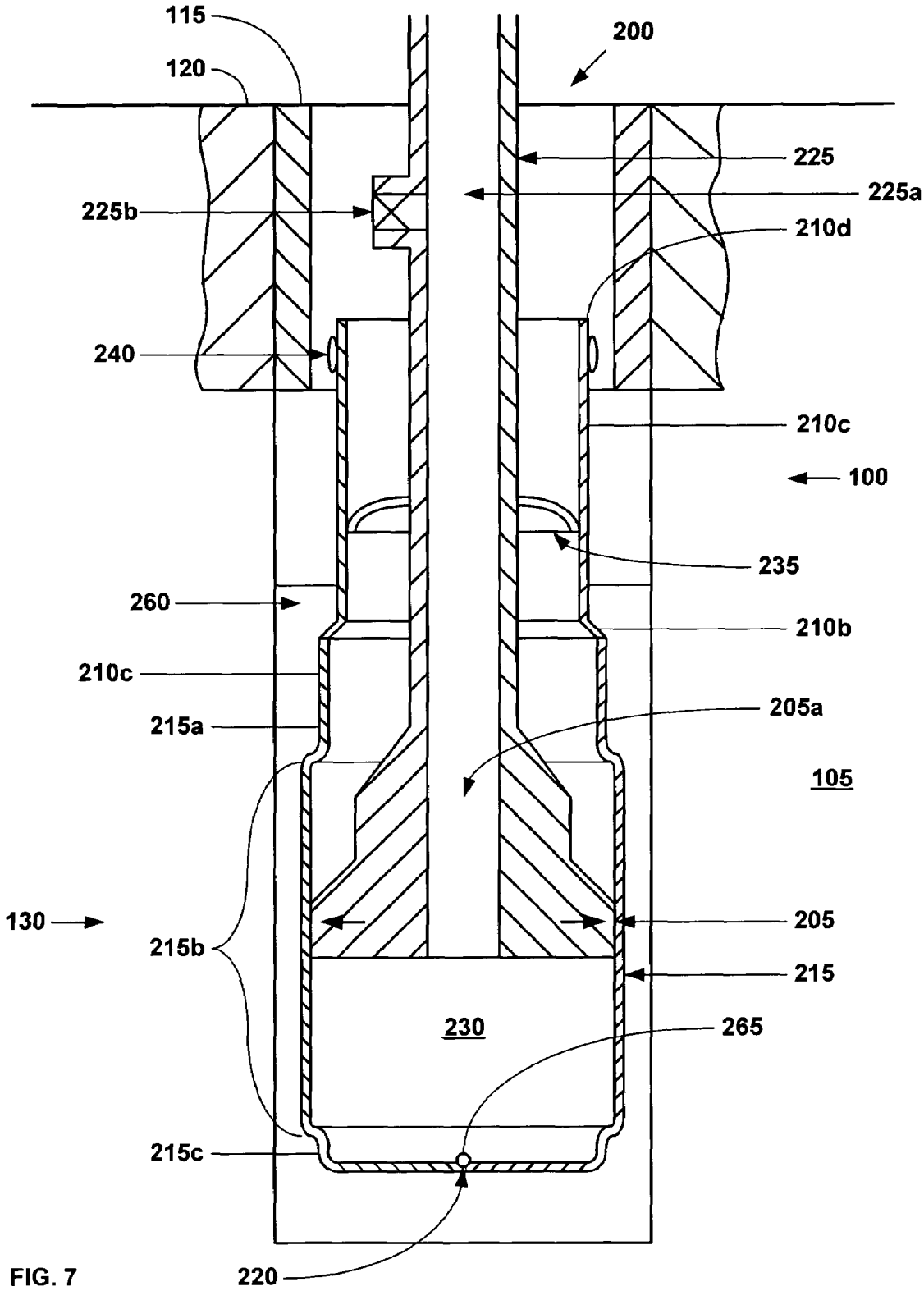
FIG. 7 is a cross-sectional view illustrating the expansion of the expandable expansion cone of the apparatus of FIG. 6.

As illustrated in FIG. 7, in a preferred embodiment, the outside diameter of the expansion cone 205 is then increased. In a preferred embodiment, the outside diameter of the expansion cone 205 is increased as disclosed in U.S. Pat. No. 5,348,095, and/or 6,012,523, the disclosures of which are incorporate herein by reference. In a preferred embodiment, the outside diameter of the radially expanded expansion cone 205 is substantially equal to the inside diameter of the preexisting wellbore casing 115.

In an alternative embodiment, the expansion cone 205 is not lowered into the radially expanded portion of the shoe 215 prior to being radially expanded. In this manner, the upper portion 210*c* of the shoe 210 may be radially expanded by the radial expansion of the expansion cone 205.

In another alternative embodiment, the expansion cone 205 is not radially expanded.

Figure 8:
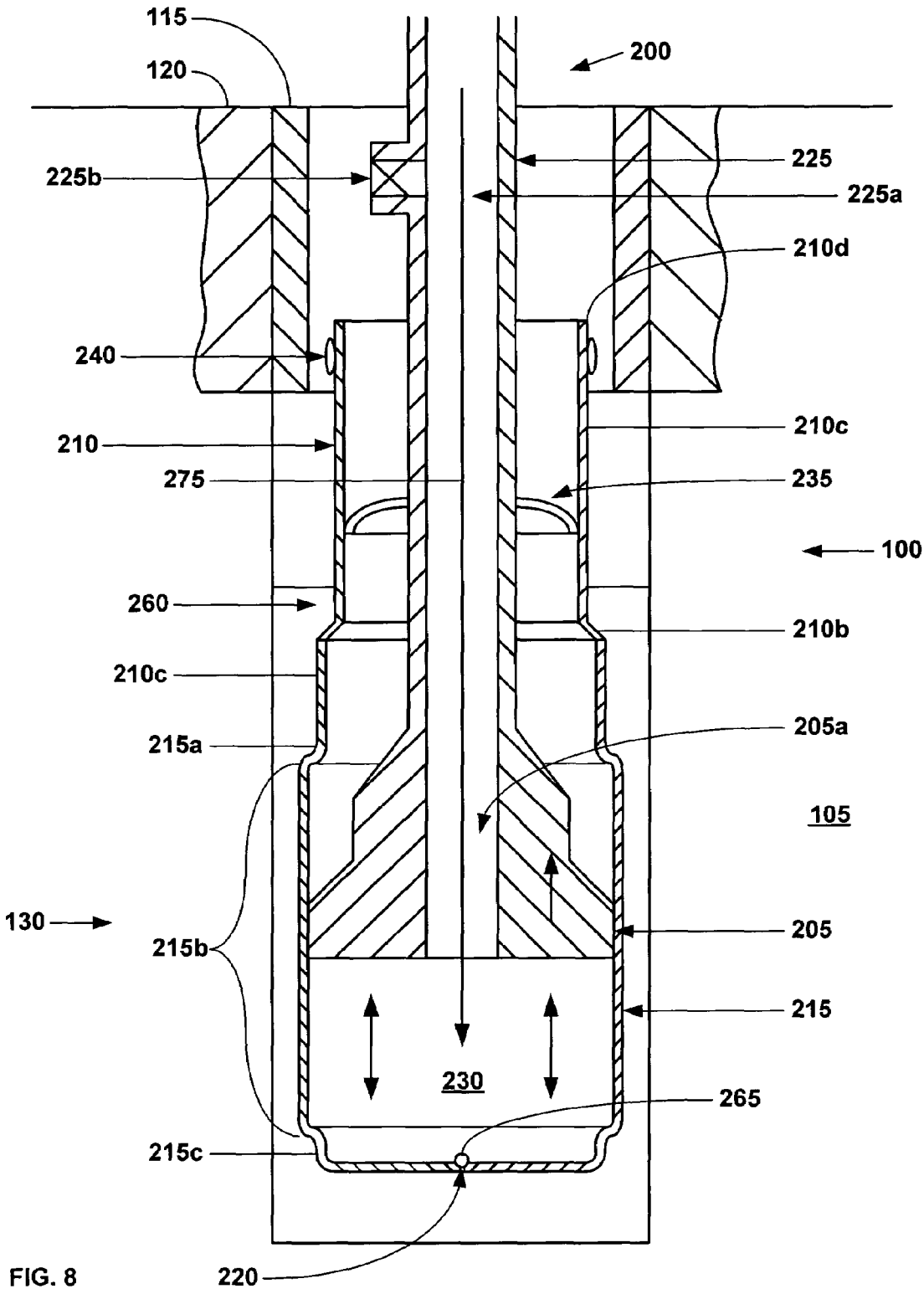
FIG. 8 is a cross-sectional view illustrating the injection of fluidic material into the radially expanded shoe of the apparatus of FIG. 7.

As illustrated in FIG. 8, in a preferred embodiment, a fluidic material 275 is then injected into the region 230 through the fluid passages 225*a* and 205*a*. In a preferred embodiment, once the interior region 230 becomes sufficiently pressurized, the upper portion 215*a* of the shoe 215 and the tubular member 210 are preferably plastically deformed, radially expanded, and extruded off of the expansion cone 205. Furthermore, in a preferred embodiment, during the end of the radial expansion process, the upper portion 210*d* of the tubular member and the lower portion of the preexisting casing 115 that overlap with one another are simultaneously plastically deformed and radially expanded. In this manner, a mono-diameter wellbore casing may be formed that includes the preexisting wellbore casing 115 and the radially expanded tubular member 210.

During the extrusion process, the expansion cone 205 may be raised out of the expanded portion of the tubular member 210. In a preferred embodiment, during the extrusion process, the expansion cone 205 is raised at approximately the same rate as the tubular member 210 is expanded in order to keep the tubular member 210 stationary relative to the new wellbore section 130. In this manner, an overlapping joint between the radially expanded tubular member 210 and the lower portion of the preexisting casing 115 may be optimally formed. In an alternative preferred embodiment, the expansion cone 205 is maintained in a stationary position during the extrusion process thereby allowing the tubular member 210 to extrude off of the expansion cone 205 and into the new wellbore section 130 under the force of gravity and the operating pressure of the interior region 230.

In a preferred embodiment, when the upper end portion 210*d* of the tubular member 210 and the lower portion of the preexisting casing 115 that overlap with one another are plastically deformed and radially expanded by the expansion cone 205, the expansion cone 205 is displaced out of the wellbore 100 by both the operating pressure within the region 230 and a upwardly directed axial force applied to the tubular support member 225.

The overlapping joint between the lower portion of the preexisting casing 115 and the radially expanded tubular member 210 preferably provides a gaseous and fluidic seal. In a particularly preferred embodiment, the sealing members 245 optimally provide a fluidic and gaseous seal in the overlapping joint. In an alternative embodiment, the sealing members 245 are omitted.

In a preferred embodiment, the operating pressure and flow rate of the fluidic material 275 is controllably ramped down when the expansion cone 205 reaches the upper end portion 210*d* of the tubular member 210. In this manner, the sudden release of pressure caused by the complete extrusion of the tubular member 210 off of the expansion cone 205 can be minimized. In a preferred embodiment, the operating pressure is reduced in a substantially linear fashion from 100% to about 10% during the end of the extrusion process beginning when the expansion cone 205 is within about 5 feet from completion of the extrusion process.

Alternatively, or in combination, the wall thickness of the upper end portion 210*d* of the tubular member is tapered in order to gradually reduce the required operating pressure for plastically deforming and radially expanding the upper end portion of the tubular member. In this manner, shock loading of the apparatus is at least reduced.

Alternatively, or in combination, a shock absorber is provided in the support member 225 in order to absorb the shock caused by the sudden release of pressure. The shock absorber may comprise, for example, any conventional commercially available shock absorber, bumper sub, or jars adapted for use in wellbore operations.

Alternatively, or in combination, an expansion cone catching structure is provided in the upper end portion 210*d* of the tubular member 210 in order to catch or at least decelerate the expansion cone 205.

In a preferred embodiment, the apparatus 200 is adapted to minimize tensile, burst, and friction effects upon the tubular member 210 during the expansion process. These effects will be depend upon the geometry of the expansion cone 205, the material composition of the tubular member 210 and expansion cone 205, the inner diameter of the tubular member 210, the wall thickness of the tubular member 210, the type of lubricant, and the yield strength of the tubular member 210. In general, the thicker the wall thickness, the smaller the inner diameter, and the greater the yield strength of the tubular member 210, then the greater the operating pressures required to extrude the tubular member 210 off of the expansion cone 205.

For typical tubular members 210, the extrusion of the tubular member 210 off of the expansion cone 205 will begin when the pressure of the interior region 230 reaches, for example, approximately 500 to 9,000 psi.

During the extrusion process, the expansion cone 205 may be raised out of the expanded portion of the tubular member 210 at rates ranging, for example, from about 0 to 5 ft/sec. In a preferred embodiment, during the extrusion process, the expansion cone 205 is raised out of the expanded portion of the tubular member 210 at rates ranging from about 0 to 2 ft/sec in order to minimize the time required for the expansion process while also permitting easy control of the expansion process.

Figure 9:
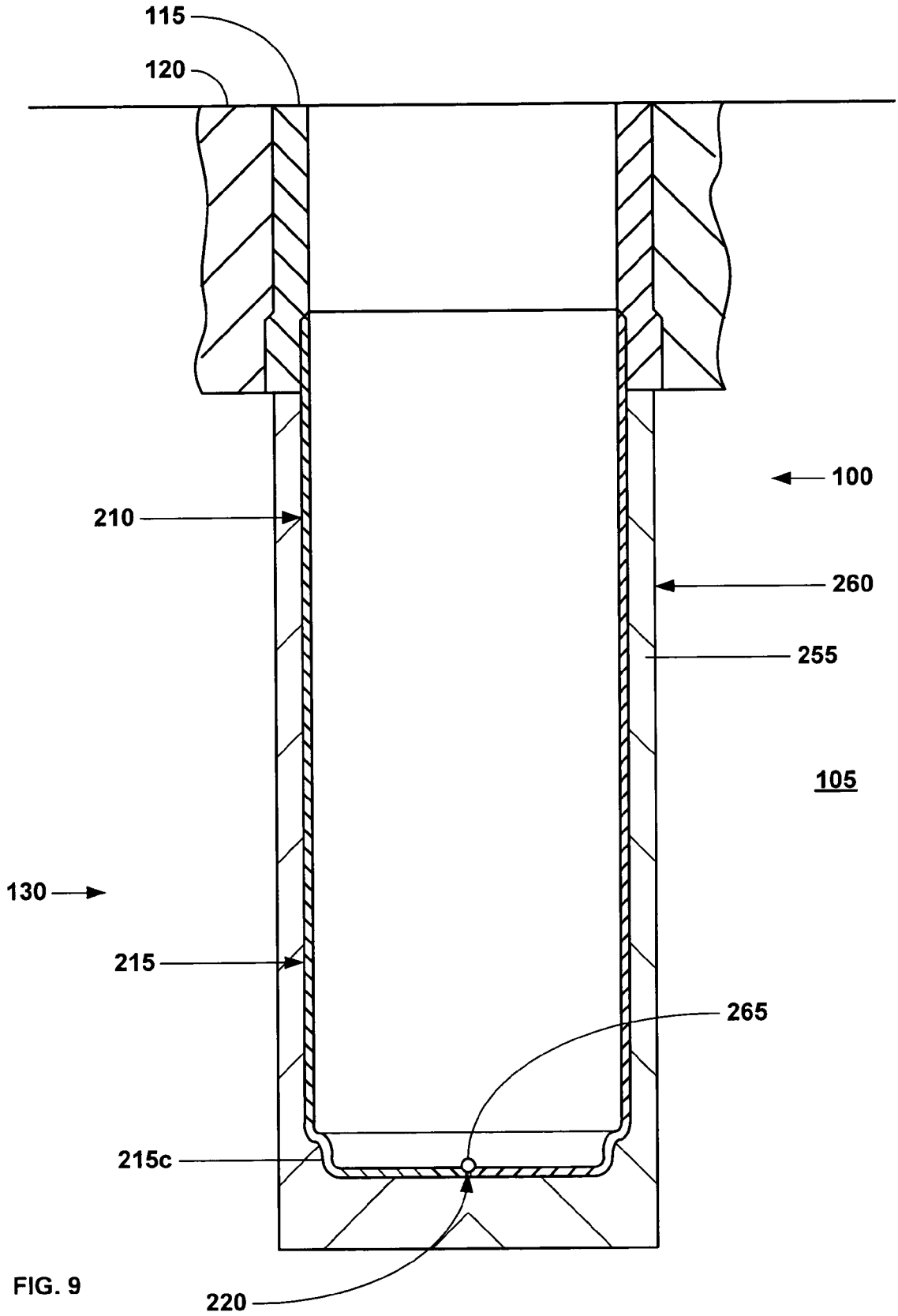
FIG. 9 is a cross-sectional view illustrating the completion of the radial expansion of the expandable tubular member of the apparatus of FIG. 8.

As illustrated in FIG. 9, once the extrusion process is completed, the expansion cone 205 is removed from the wellbore 100. In a preferred embodiment, either before or after the removal of the expansion cone 205, the integrity of the fluidic seal of the overlapping joint between the upper end portion 210*d* of the tubular member 210 and the lower end portion 115*a* of the preexisting wellbore casing 115 is tested using conventional methods.

In a preferred embodiment, if the fluidic seal of the overlapping joint between the upper end portion 210*d* of the tubular member 210 and the lower end portion 115*a* of the casing 115 is satisfactory, then any uncured portion of the material 255 within the expanded tubular member 210 is then removed in a conventional manner such as, for example, circulating the uncured material out of the interior of the expanded tubular member 210. The expansion cone 205 is then pulled out of the wellbore section 130 and a drill bit or mill is used in combination with a conventional drilling assembly to drill out any hardened material 255 within the tubular member 210. In a preferred embodiment, the material 255 within the annular region 260 is then allowed to fully cure.

Figure 10:
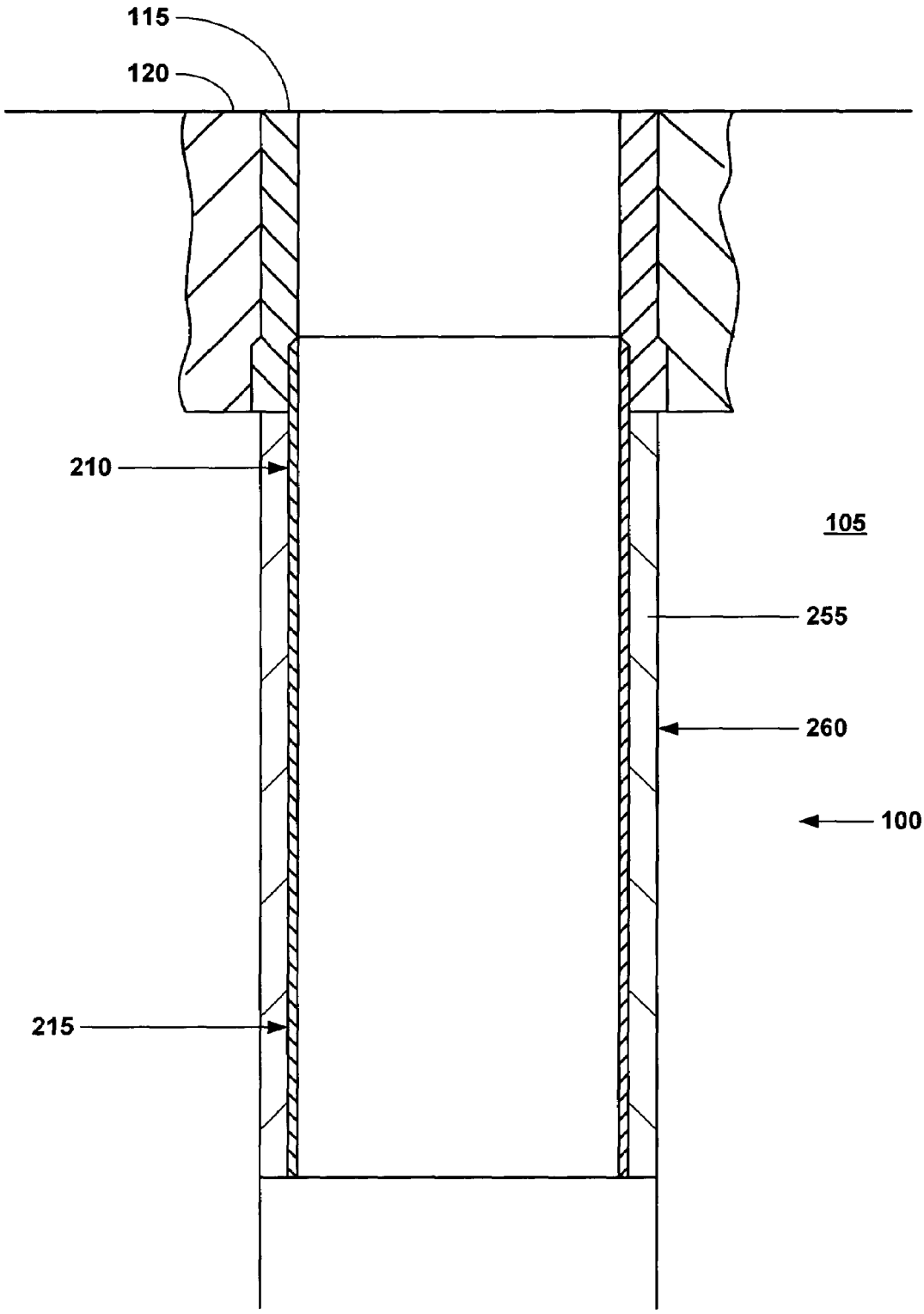
FIG. 10 is a cross-sectional view illustrating the removal of the bottom portion of the radially expanded shoe of the apparatus of FIG. 9.\

As illustrated in FIG. 10, the bottom portion 215*c* of the shoe 215 may then be removed by drilling out the bottom portion of the shoe using conventional drilling methods. The wellbore 100 may then be extended in a conventional manner using a conventional drilling assembly. In a preferred embodiment, the inside diameter of the extended portion of the wellbore 100 is greater than the inside diameter of the radially expanded shoe 215.

Figure 11:
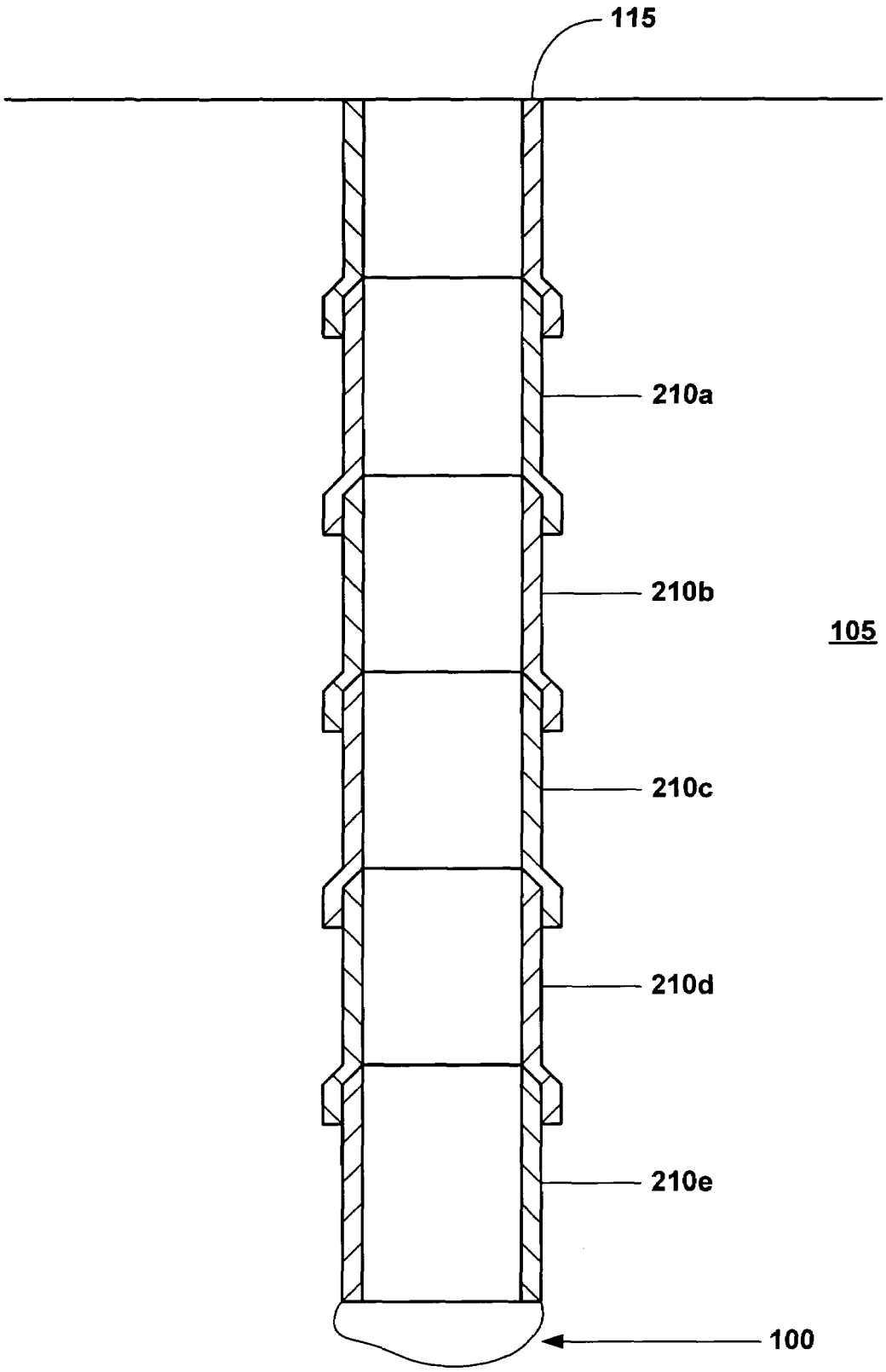
FIG. 11 is a cross-sectional view illustrating the formation of a mono-diameter wellbore casing that includes a plurality of overlapping mono-diameter wellbore casings.

As illustrated in FIG. 11, the method of FIGS. 1–10 may be repeatedly performed in order to provide a mono-diameter wellbore casing that includes overlapping wellbore casings 115 and 210*a*–210*e*. The wellbore casing 115, and 210*a*–210*e* preferably include outer annular layers of fluidic sealing material. Alternatively, the outer annular layers of fluidic sealing material may be omitted. In this manner, a mono-diameter wellbore casing may be formed within the subterranean formation that extends for tens of thousands of feet. More generally still, the teachings of FIGS. 1–11 may be used to form a mono-diameter wellbore casing, a pipeline, a structural support, or a tunnel within a subterranean formation at any orientation from the vertical to the horizontal.

In a preferred embodiment, the formation of a mono-diameter wellbore casing, as illustrated in FIGS. 1–11, is further provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, and (22) U.S. provisional patent application Ser. No. 60/262,434, filed on Jan. 17, 2001, the disclosures of which are incorporated herein by reference.

Referring to FIGS. 12, 12*a*, 12*b*, 12*c*, and 12*d*, in an alternative embodiment, an apparatus 300 for forming a mono-diameter wellbore casing is positioned within the wellbore casing 115 that is substantially identical in design and operation to the apparatus 200 except that a shoe 305 is substituted for the shoe 215.

In a preferred embodiment, the shoe 305 includes an upper portion 305*a*, an intermediate portion 305*b*, and a lower portion 305*c* having a valveable fluid passage 310 that is preferably adapted to receive a plug, dart, or other similar element for controllably sealing the fluid passage 310. In this manner, the fluid passage 310 may be optimally sealed off by introducing a plug, dart and/or ball sealing elements into the fluid passage 310.

The upper and lower portions, 305*a* and 305*c*, of the shoe 305 are preferably substantially tubular, and the intermediate portion 305*b* of the shoe includes corrugations 305*ba*–305*bh*. Furthermore, in a preferred embodiment, when the intermediate portion 305*b* of the shoe 305 is radially expanded by the application of fluid pressure to the interior 315 of the shoe 305, the inside and outside diameters of the radially expanded intermediate portion are preferably both greater than the inside and outside diameters of the upper and lower portions, 305*a* and 305*c*. In this manner, the outer circumference of the intermediate portion 305*b* of the shoe 305 is preferably greater than the outer circumferences of the upper and lower portions, 305*a* and 305*c*, of the shoe.

In a preferred embodiment, the shoe 305 further includes one or more through and side outlet ports in fluidic communication with the fluid passage 310. In this manner, the shoe 305 optimally injects hardenable fluidic sealing material into the region outside the shoe 305 and tubular member 210.

In an alternative embodiment, the flow passage 310 is omitted.

Figure 12:
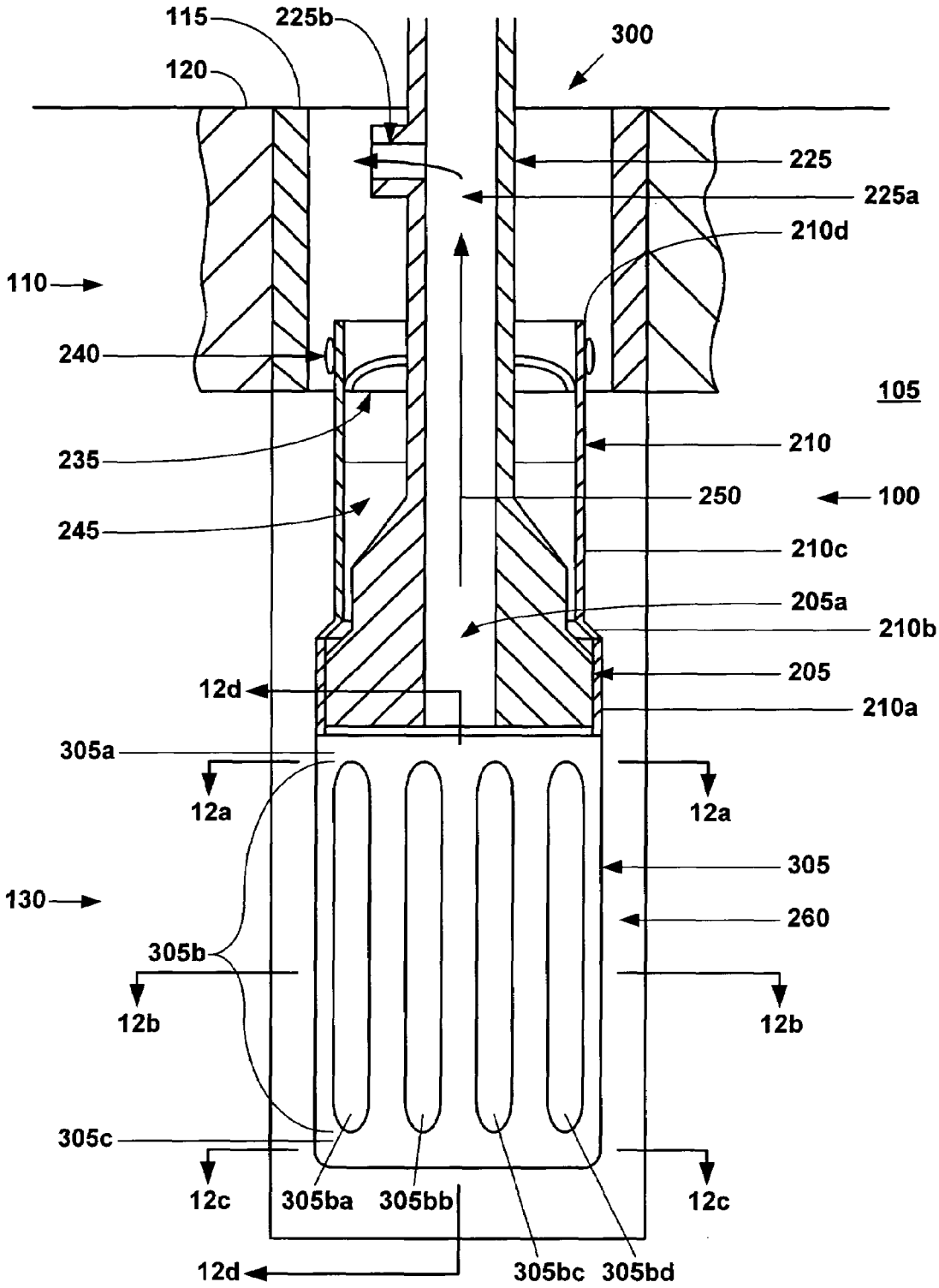
FIG. 12 is a fragmentary cross-sectional view illustrating the placement of an alternative embodiment of an apparatus for creating a mono-diameter wellbore casing within the wellbore of FIG. 1.
Figure 12A:
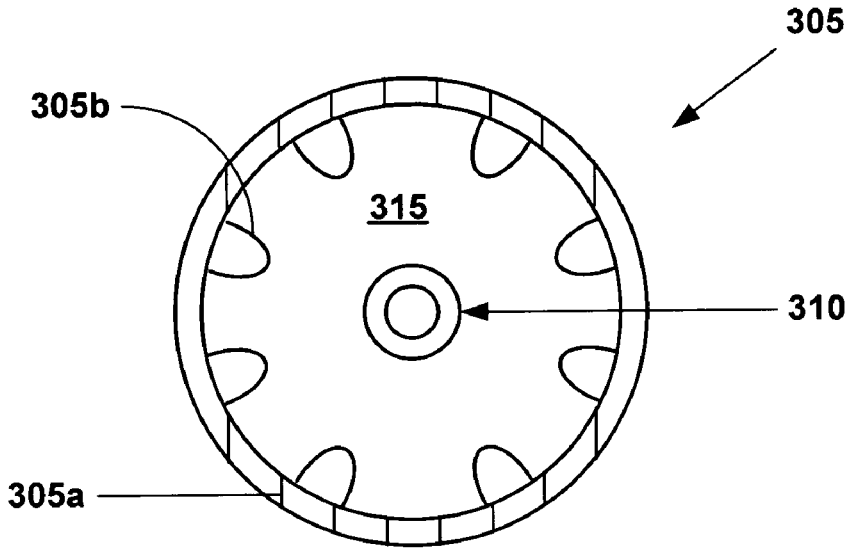
FIG. 12*a* is a cross-sectional view of a portion of the shoe of the apparatus of FIG. 12.
Figure 12B:
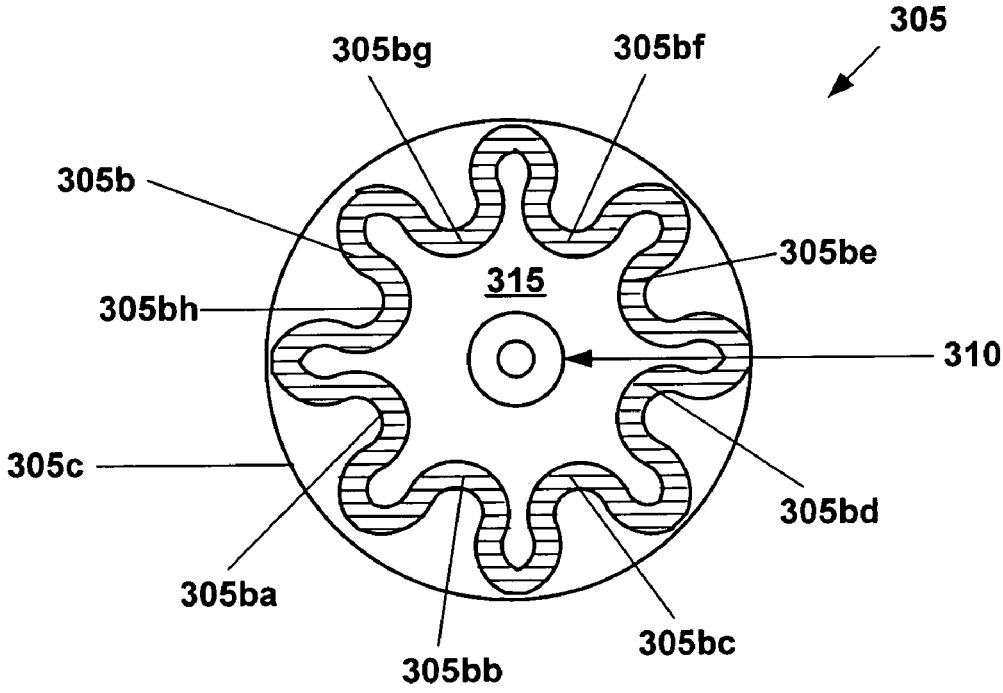
FIG. 12*b* is a cross-sectional view of a portion of the shoe of the apparatus of FIG. 12.
Figure 12C:
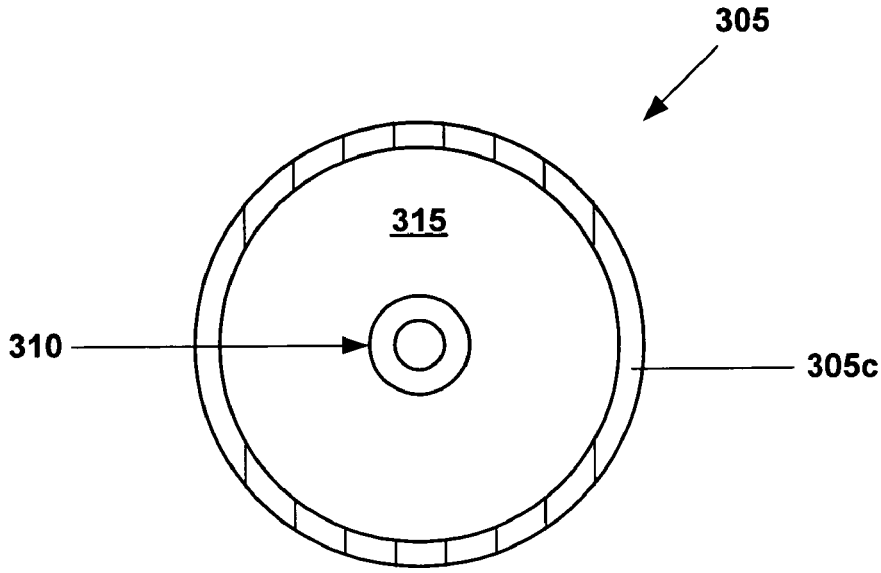
FIG. 12*c* is a cross-sectional view of another portion of the shoe of the apparatus of FIG. 12.
Figure 12D:
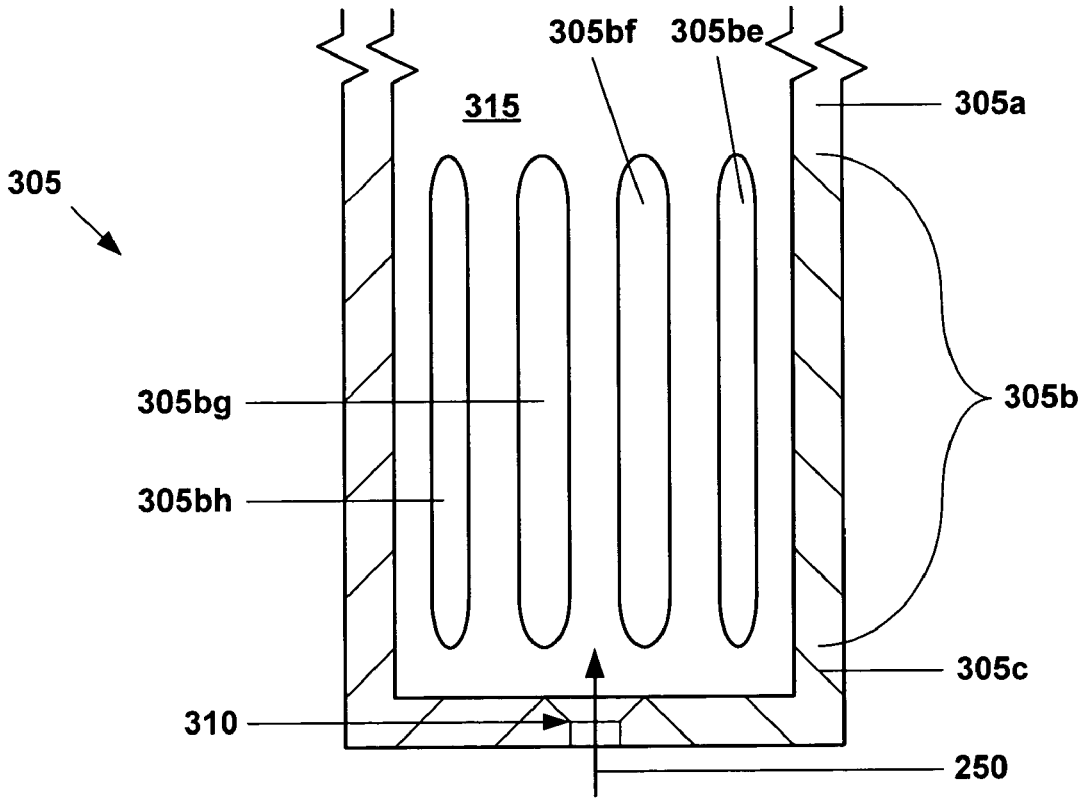
FIG. 12*d* is a cross-sectional view of another portion of the shoe of the apparatus of FIG. 12.

In a preferred embodiment, as illustrated in FIGS. 12 and 12*d*, during placement of the apparatus 300 within the wellbore 100, fluidic materials 250 within the wellbore that are displaced by the apparatus are conveyed through the fluid passages 310, 205*a*, 225*a*, and 225*b*. In this manner, surge pressures created by the placement of the apparatus within the wellbore 100 are reduced.

Figure 13:
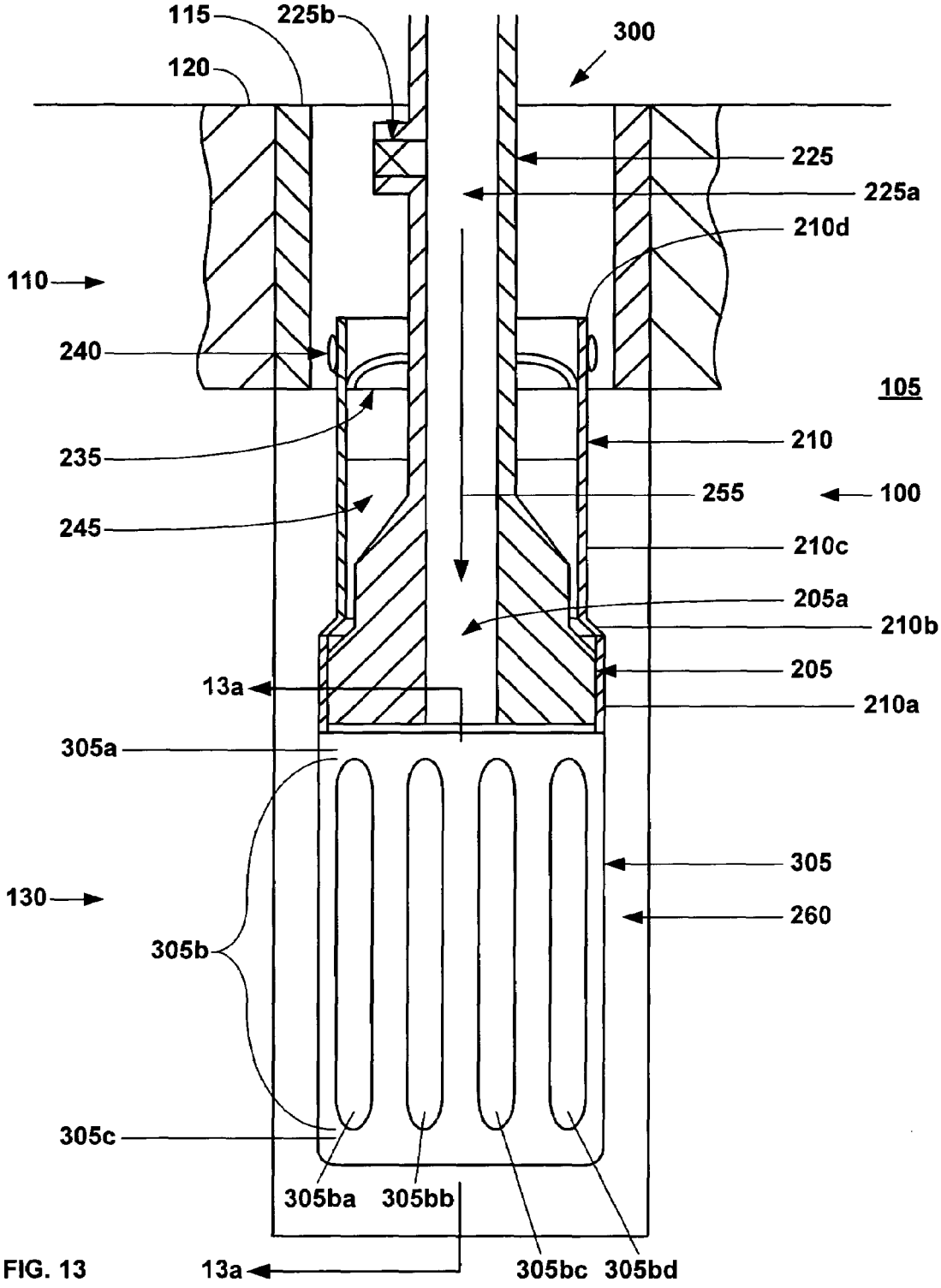
FIG. 13 is a fragmentary cross-sectional view illustrating the injection of a hardenable fluidic sealing material through the apparatus and into the new section of the well borehole of FIG. 12.
Figure 13A:
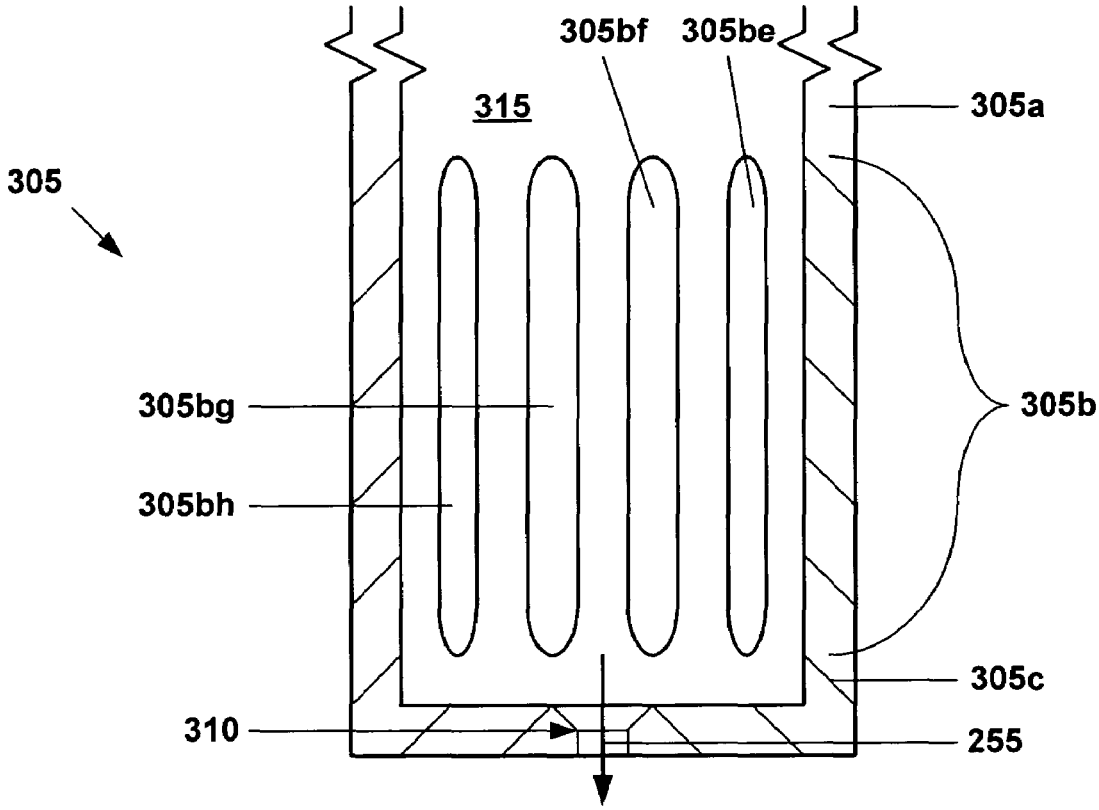
FIG. 13*a* is a cross-sectional view of a portion of the shoe of the apparatus of FIG. 13.

In a preferred embodiment, as illustrated in FIGS. 13 and 13*a*, the fluid passage 225*b* is then closed and a hardenable fluidic sealing material 255 is then pumped from a surface location into the fluid passages 225*a* and 205*a*. The material 255 then passes from the fluid passage 205*a* into the interior region 315 of the shoe 305 below the expansion cone 205. The material 255 then passes from the interior region 315 into the fluid passage 310. The material 255 then exits the apparatus 300 and fills the annular region 260 between the exterior of the tubular member 210 and the interior wall of the new section 130 of the wellbore 100. Continued pumping of the material 255 causes the material to fill up at least a portion of the annular region 260.

The material 255 is preferably pumped into the annular region 260 at pressures and flow rates ranging, for example, from about 0 to 5000 psi and 0 to 1,500 gallons/min, respectively. The optimum flow rate and operating pressures vary as a function of the casing and wellbore sizes, wellbore section length, available pumping equipment, and fluid properties of the fluidic material being pumped. The optimum flow rate and operating pressure are preferably determined using conventional empirical methods.

The hardenable fluidic sealing material 255 may be any number of conventional commercially available hardenable fluidic sealing materials such as, for example, slag mix, cement, latex or epoxy. In a preferred embodiment, the hardenable fluidic sealing material 255 is a blended cement prepared specifically for the particular well section being drilled from Halliburton Energy Services in Dallas, Tex. in order to provide optimal support for tubular member 210 while also maintaining optimum flow characteristics so as to minimize difficulties during the displacement of cement in the annular region 260. The optimum blend of the blended cement is preferably determined using conventional empirical methods. In several alternative embodiments, the hardenable fluidic sealing material 255 is compressible before, during, or after curing.

The annular region 260 preferably is filled with the material 255 in sufficient quantities to ensure that, upon radial expansion of the tubular member 210, the annular region 260 of the new section 130 of the wellbore 100 will be filled with the material 255.

In an alternative embodiment, the injection of the material 255 into the annular region 260 is omitted.

Figure 14:
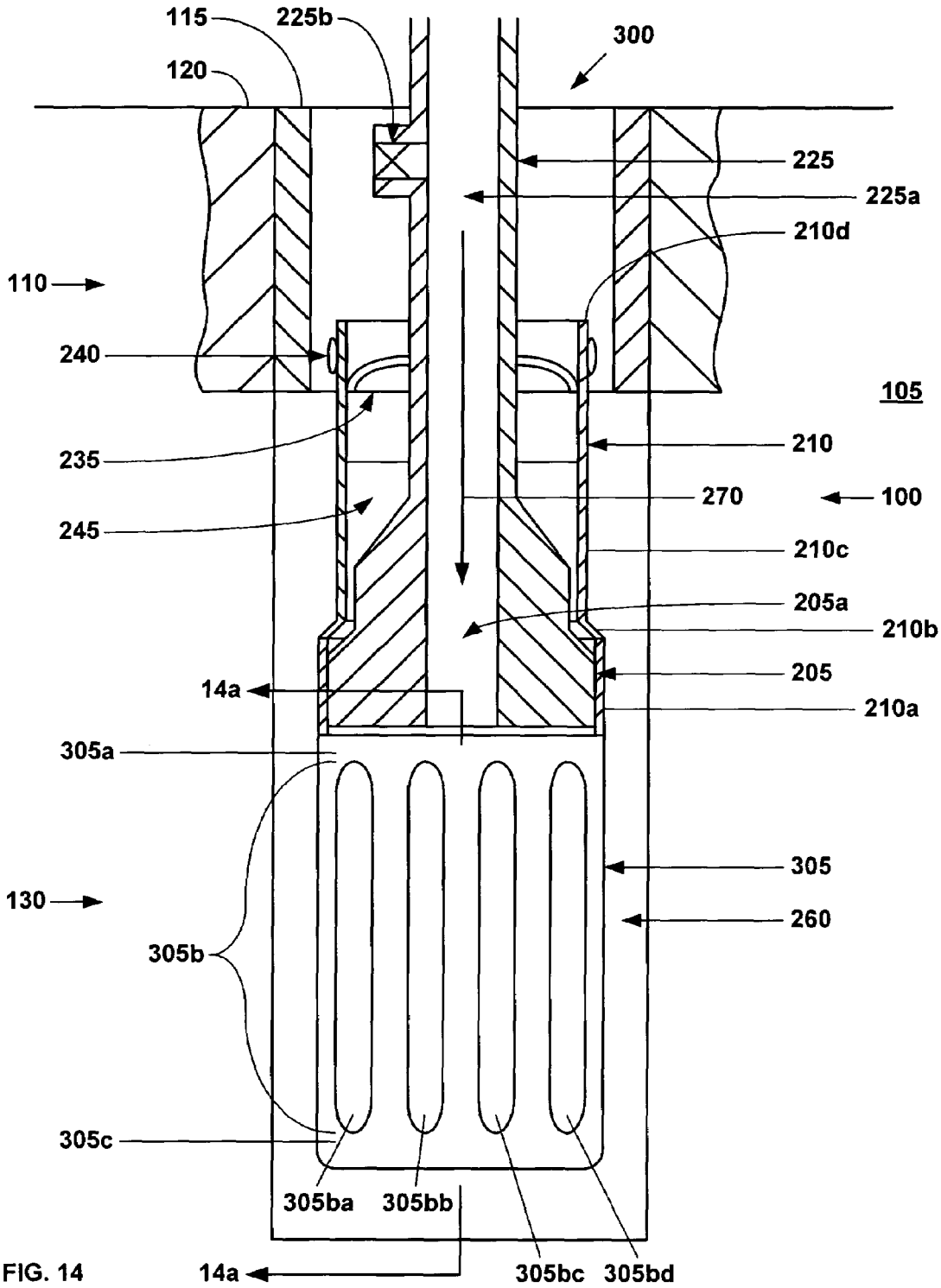
FIG. 14 is a fragmentary cross-sectional view illustrating the injection of a fluidic material into the apparatus of FIG. 13 in order to fluidicly isolate the interior of the shoe.\
Figure 14A:
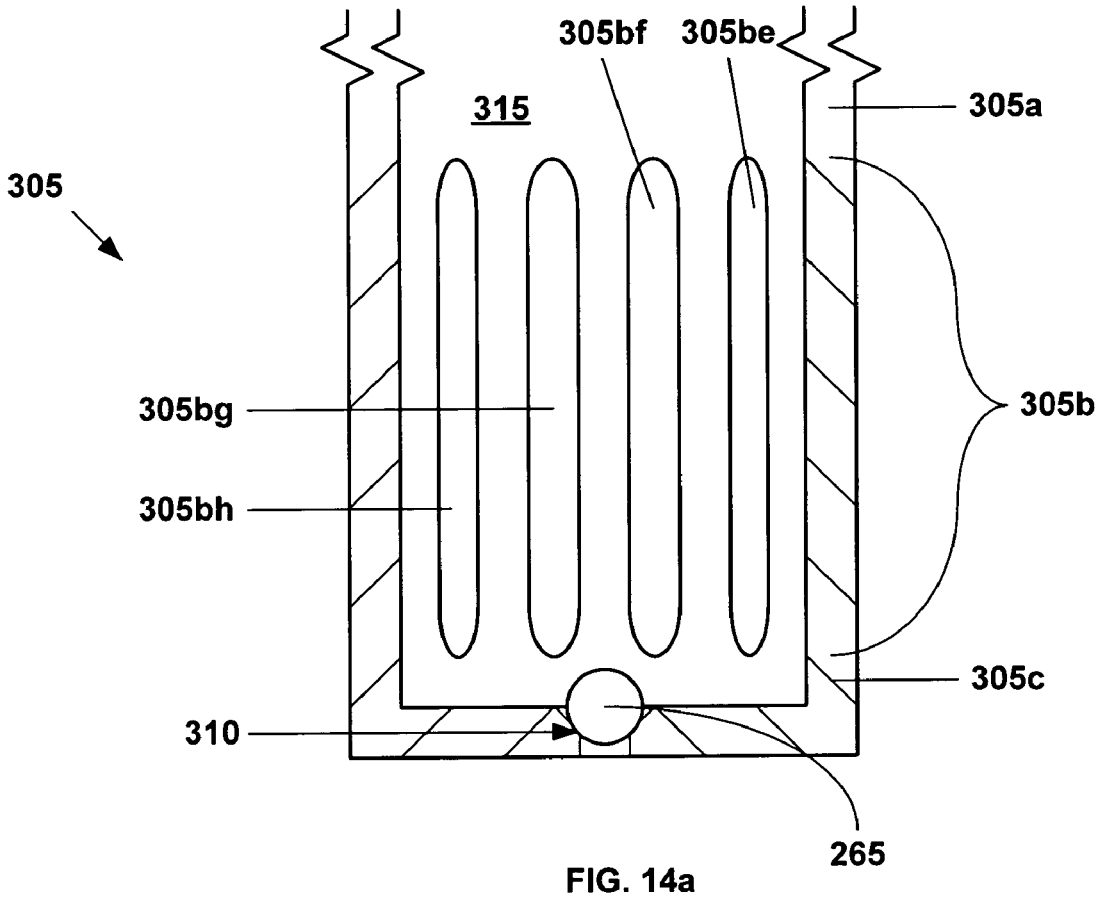
FIG. 14*a* is a cross-sectional view of a portion of the shoe of the apparatus of FIG. 14.

As illustrated in FIGS. 14 and 14*a*, once the annular region 260 has been adequately filled with the material 255, a plug 265, or other similar device, is introduced into the fluid passage 310, thereby fluidicly isolating the interior region 315 from the annular region 260. In a preferred embodiment, a non-hardenable fluidic material 270 is then pumped into the interior region 315 causing the interior region to pressurize. In this manner, the interior region 315 will not contain significant amounts of the cured material 255. This also reduces and simplifies the cost of the entire process. Alternatively, the material 255 may be used during this phase of the process.

Figure 15:
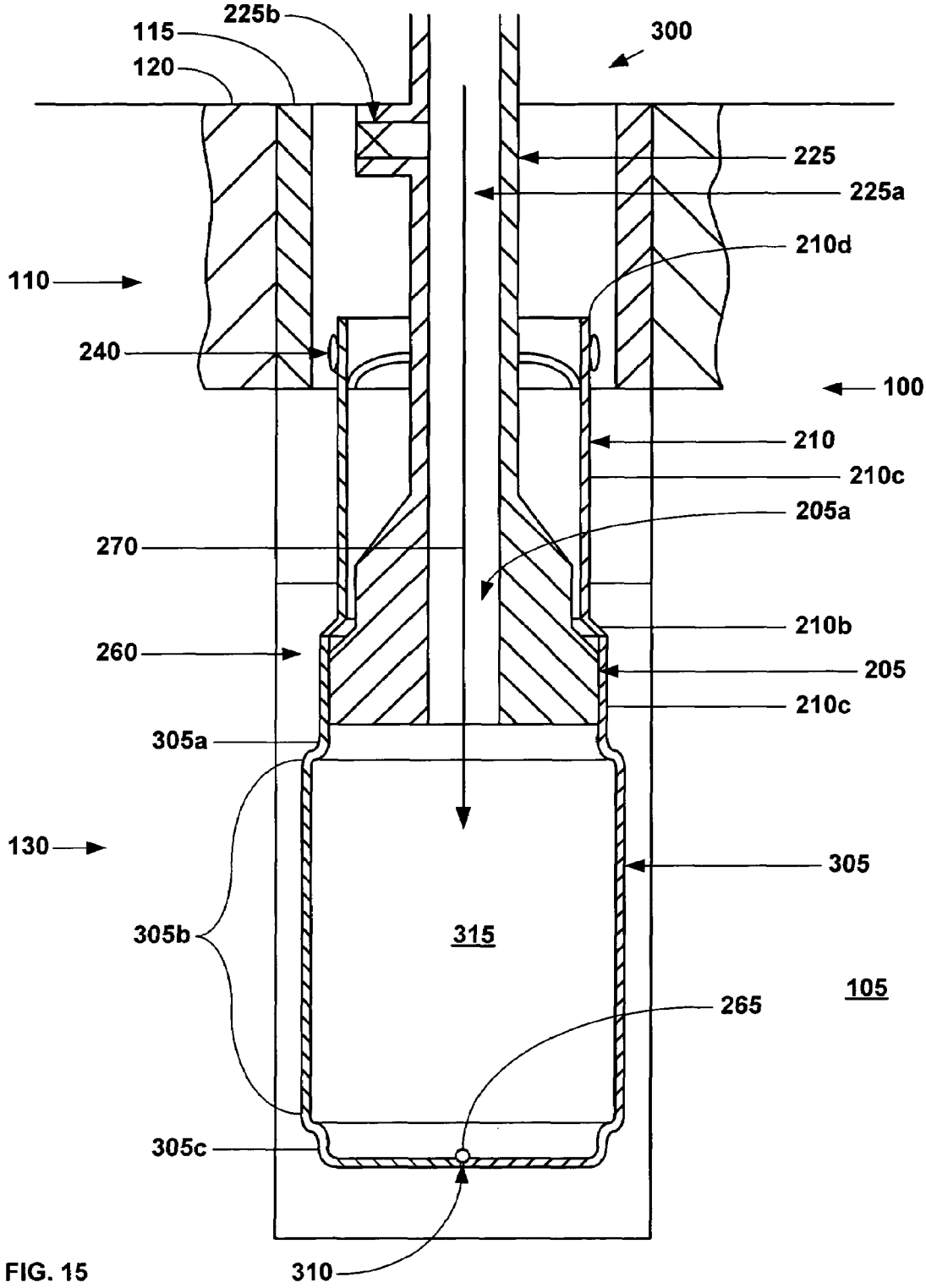
FIG. 15 is a cross-sectional view illustrating the radial expansion of the shoe of FIG. 14.

As illustrated in FIG. 15, in a preferred embodiment, the continued injection of the fluidic material 270 pressurizes the region 315 and unfolds the corrugations 305*ba*–305*bh* of the intermediate portion 305*b* of the shoe 305. In a preferred embodiment, the outside diameter of the unfolded intermediate portion 305*b* of the shoe 305 is greater than the outside diameter of the upper and lower portions, 305*a* and 305*b*, of the shoe. In a preferred embodiment, the inside and outside diameters of the unfolded intermediate portion 305*b* of the shoe 305 are greater than the inside and outside diameters, respectively, of the upper and lower portions, 305*a* and 305*b*, of the shoe. In a preferred embodiment, the inside diameter of the unfolded intermediate portion 305*b* of the shoe 305 is substantially equal to or greater than the inside diameter of the preexisting casing 305 in order to optimize the formation of a mono-diameter wellbore casing.

Figure 16:
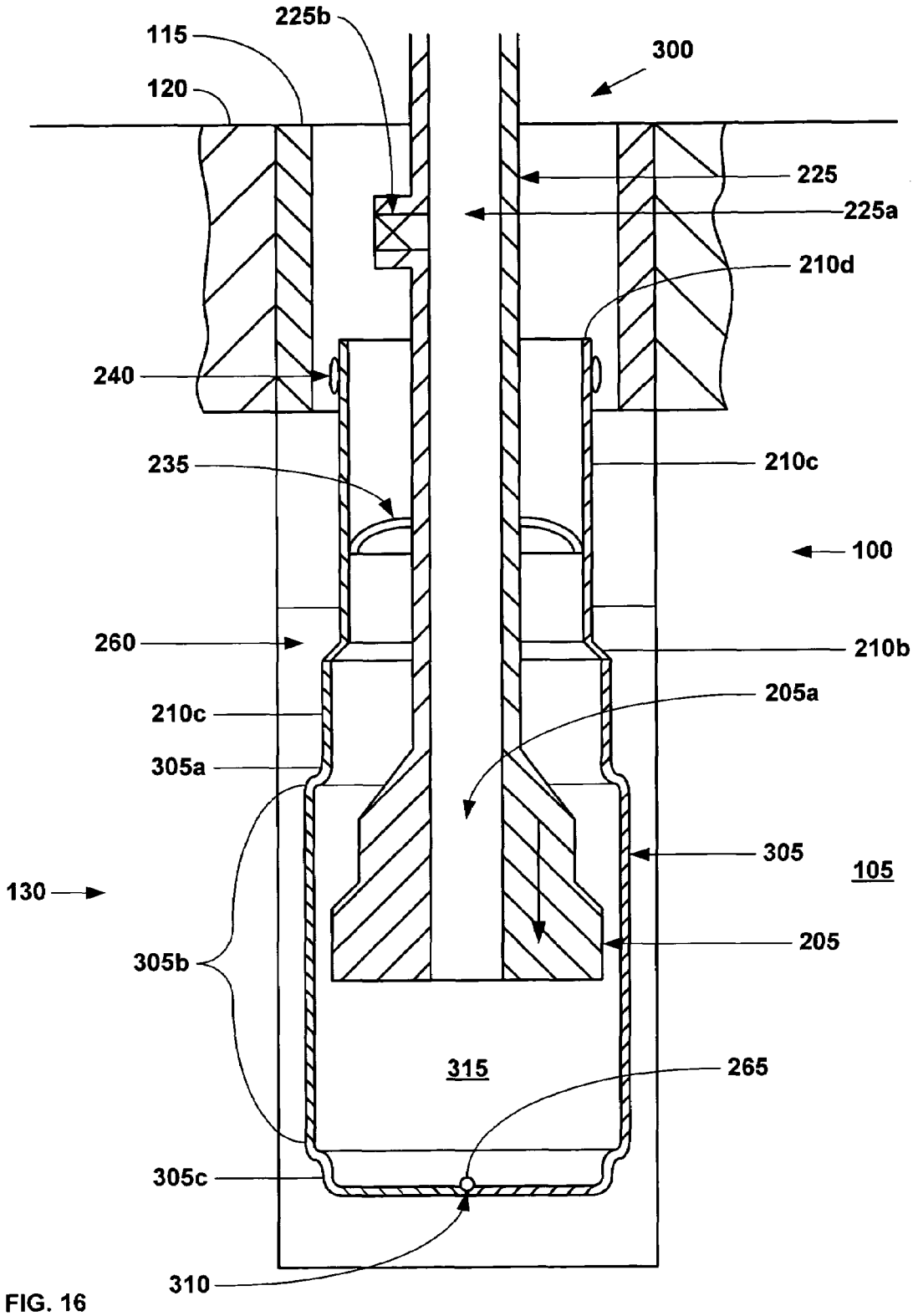
FIG. 16 is a cross-sectional view illustrating the lowering of the expandable expansion cone into the radially expanded shoe of the apparatus of FIG. 15.

As illustrated in FIG. 16, in a preferred embodiment, the expansion cone 205 is then lowered into the unfolded intermediate portion 305*b* of the shoe 305. In a preferred embodiment, the expansion cone 205 is lowered into the unfolded intermediate portion 305*b* of the shoe 305 until the bottom of the expansion cone is proximate the lower portion 305*c* of the shoe 305. In a preferred embodiment, during the lowering of the expansion cone 205 into the unfolded intermediate portion 305*b* of the shoe 305, the material 255 within the annular region 260 maintains the shoe 305 in a substantially stationary position.

Figure 17:
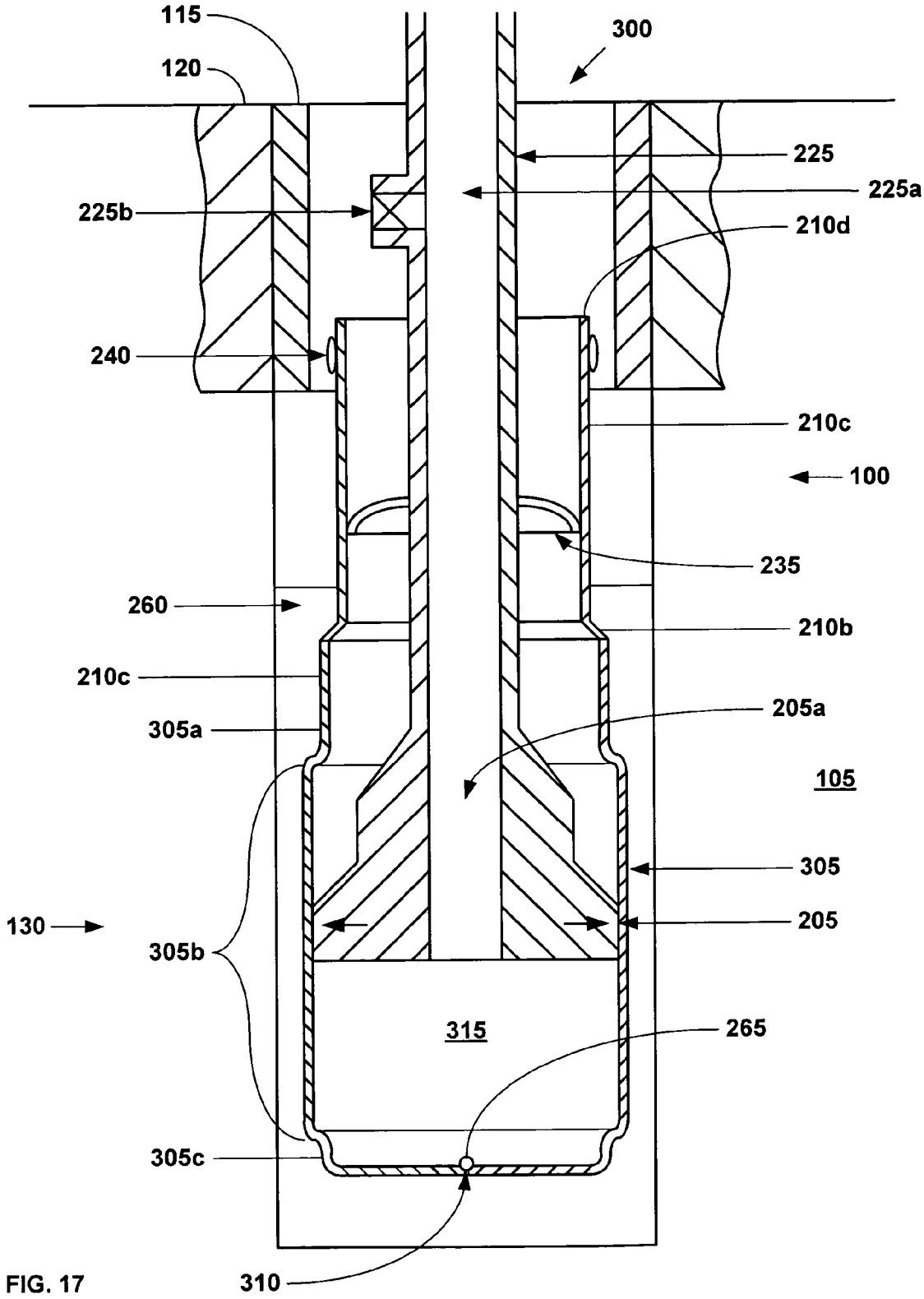
FIG. 17 is a cross-sectional view illustrating the expansion of the expandable expansion cone of the apparatus of FIG. 16.

As illustrated in FIG. 17, in a preferred embodiment, the outside diameter of the expansion cone 205 is then increased. In a preferred embodiment, the outside diameter of the expansion cone 205 is increased as disclosed in U.S. Pat. No. 5,348,095, and/or 6,012,523, the disclosures of which are incorporate herein by reference. In a preferred embodiment, the outside diameter of the radially expanded expansion cone 205 is substantially equal to the inside diameter of the preexisting wellbore casing 115.

In an alternative embodiment, the expansion cone 205 is not lowered into the radially expanded portion of the shoe 305 prior to being radially expanded. In this manner, the upper portion 305*c* of the shoe 305 may be radially expanded by the radial expansion of the expansion cone 205.

In another alternative embodiment, the expansion cone 205 is not radially expanded.

Figure 18:
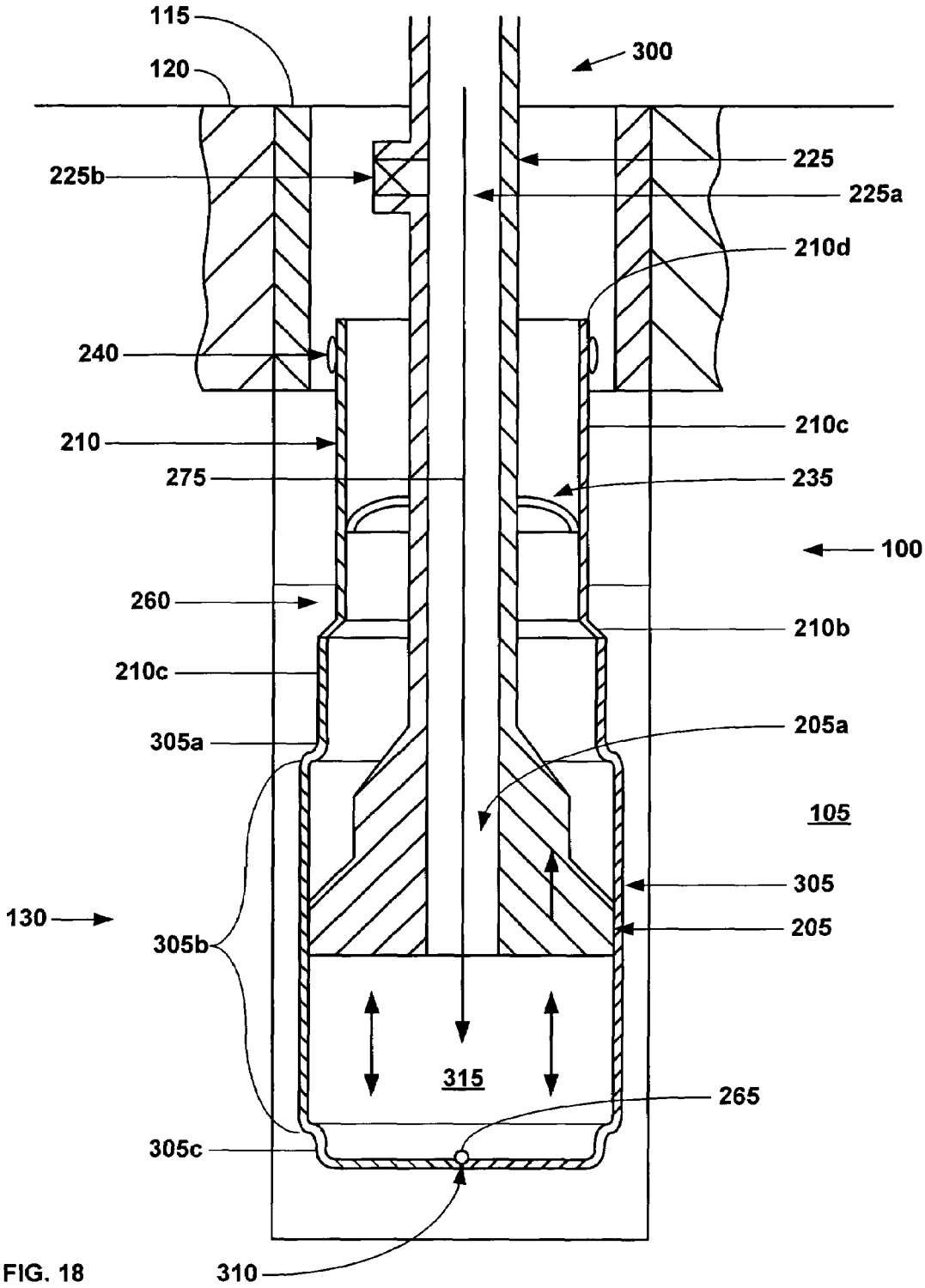
FIG. 18 is a cross-sectional view illustrating the injection of fluidic material into the radially expanded shoe of the apparatus of FIG. 17.

As illustrated in FIG. 18, in a preferred embodiment, a fluidic material 275 is then injected into the region 315 through the fluid passages 225*a* and 205*a*. In a preferred embodiment, once the interior region 315 becomes sufficiently pressurized, the upper portion 305*a* of the shoe 305 and the tubular member 210 are preferably plastically deformed, radially expanded, and extruded off of the expansion cone 205. Furthermore, in a preferred embodiment, during the end of the radial expansion process, the upper portion 210*d* of the tubular member and the lower portion of the preexisting casing 115 that overlap with one another are simultaneously plastically deformed and radially expanded. In this manner, a mono-diameter wellbore casing may be formed that includes the preexisting wellbore casing 115 and the radially expanded tubular member 210.

During the extrusion process, the expansion cone 205 may be raised out of the expanded portion of the tubular member 210. In a preferred embodiment, during the extrusion process, the expansion cone 205 is raised at approximately the same rate as the tubular member 210 is expanded in order to keep the tubular member 210 stationary relative to the new wellbore section 130. In this manner, an overlapping joint between the radially expanded tubular member 210 and the lower portion of the preexisting casing 115 may be optimally formed. In an alternative preferred embodiment, the expansion cone 205 is maintained in a stationary position during the extrusion process thereby allowing the tubular member 210 to extrude off of the expansion cone 205 and into the new wellbore section 130 under the force of gravity and the operating pressure of the interior region 230.

In a preferred embodiment, when the upper end portion 210*d* of the tubular member 210 and the lower portion of the preexisting casing 115 that overlap with one another are plastically deformed and radially expanded by the expansion cone 205, the expansion cone 205 is displaced out of the wellbore 100 by both the operating pressure within the region 230 and a upwardly directed axial force applied to the tubular support member 225.

The overlapping joint between the lower portion of the preexisting casing 115 and the radially expanded tubular member 210 preferably provides a gaseous and fluidic seal. In a particularly preferred embodiment, the sealing members 245 optimally provide a fluidic and gaseous seal in the overlapping joint. In an alternative embodiment, the sealing members 245 are omitted.

In a preferred embodiment, the operating pressure and flow rate of the fluidic material 275 is controllably ramped down when the expansion cone 205 reaches the upper end portion 210*d* of the tubular member 210. In this manner, the sudden release of pressure caused by the complete extrusion of the tubular member 210 off of the expansion cone 205 can be minimized. In a preferred embodiment, the operating pressure is reduced in a substantially linear fashion from 100% to about 10% during the end of the extrusion process beginning when the expansion cone 205 is within about 5 feet from completion of the extrusion process.

Alternatively, or in combination, the wall thickness of the upper end portion 210*d* of the tubular member is tapered in order to gradually reduce the required operating pressure for plastically deforming and radially expanding the upper end portion of the tubular member. In this manner, shock loading of the apparatus may be at least partially minimized.

Alternatively, or in combination, a shock absorber is provided in the support member 225 in order to absorb the shock caused by the sudden release of pressure. The shock absorber may comprise, for example, any conventional commercially available shock absorber adapted for use in wellbore operations.

Alternatively, or in combination, an expansion cone catching structure is provided in the upper end portion 210*d* of the tubular member 210 in order to catch or at least decelerate the expansion cone 205.

In a preferred embodiment, the apparatus 200 is adapted to minimize tensile, burst, and friction effects upon the tubular member 210 during the expansion process. These effects will be depend upon the geometry of the expansion cone 205, the material composition of the tubular member 210 and expansion cone 205, the inner diameter of the tubular member 210, the wall thickness of the tubular member 210, the type of lubricant, and the yield strength of the tubular member 210. In general, the thicker the wall thickness, the smaller the inner diameter, and the greater the yield strength of the tubular member 210, then the greater the operating pressures required to extrude the tubular member 210 off of the expansion cone 205.

For typical tubular members 210, the extrusion of the tubular member 210 off of the expansion cone 205 will begin when the pressure of the interior region 230 reaches, for example, approximately 500 to 9,000 psi.

During the extrusion process, the expansion cone 205 may be raised out of the expanded portion of the tubular member 210 at rates ranging, for example, from about 0 to 5 ft/sec. In a preferred embodiment, during the extrusion process, the expansion cone 205 is raised out of the expanded portion of the tubular member 210 at rates ranging from about 0 to 2 ft/sec in order to minimize the time required for the expansion process while also permitting easy control of the expansion process.

Figure 19:
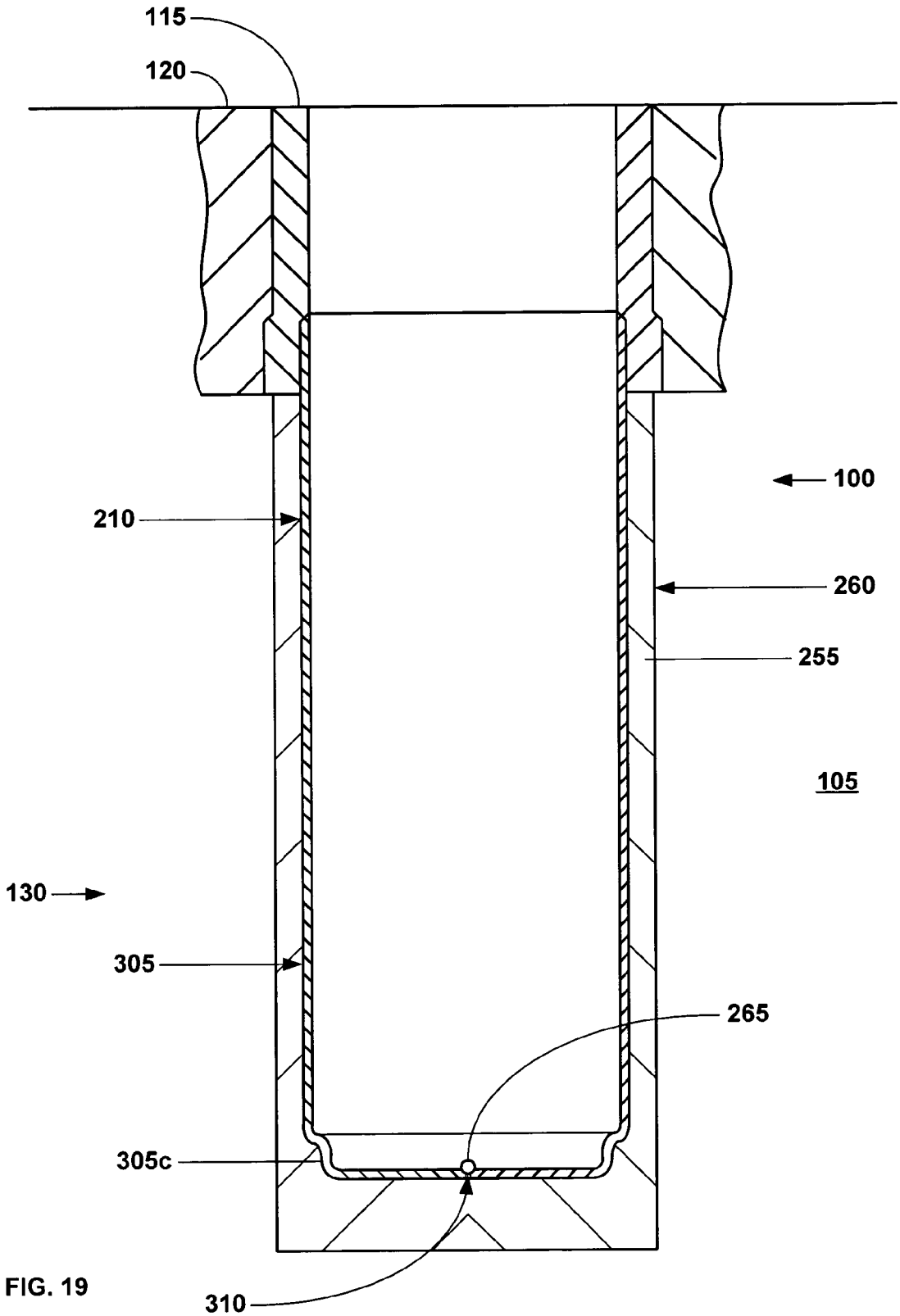
FIG. 19 is a cross-sectional view illustrating the completion of the radial expansion of the expandable tubular member of the apparatus of FIG. 18.

As illustrated in FIG. 19, once the extrusion process is completed, the expansion cone 205 is removed from the wellbore 100. In a preferred embodiment, either before or after the removal of the expansion cone 205, the integrity of the fluidic seal of the overlapping joint between the upper end portion 210*d* of the tubular member 210 and the lower end portion 115*a* of the preexisting wellbore casing 115 is tested using conventional methods.

In a preferred embodiment, if the fluidic seal of the overlapping joint between the upper end portion 210*d* of the tubular member 210 and the lower end portion 115*a* of the casing 115 is satisfactory, then any uncured portion of the material 255 within the expanded tubular member 210 is then removed in a conventional manner such as, for example, circulating the uncured material out of the interior of the expanded tubular member 210. The expansion cone 205 is then pulled out of the wellbore section 130 and a drill bit or mill is used in combination with a conventional drilling assembly to drill out any hardened material 255 within the tubular member 210. In a preferred embodiment, the material 255 within the annular region 260 is then allowed to fully cure.

Figure 20:
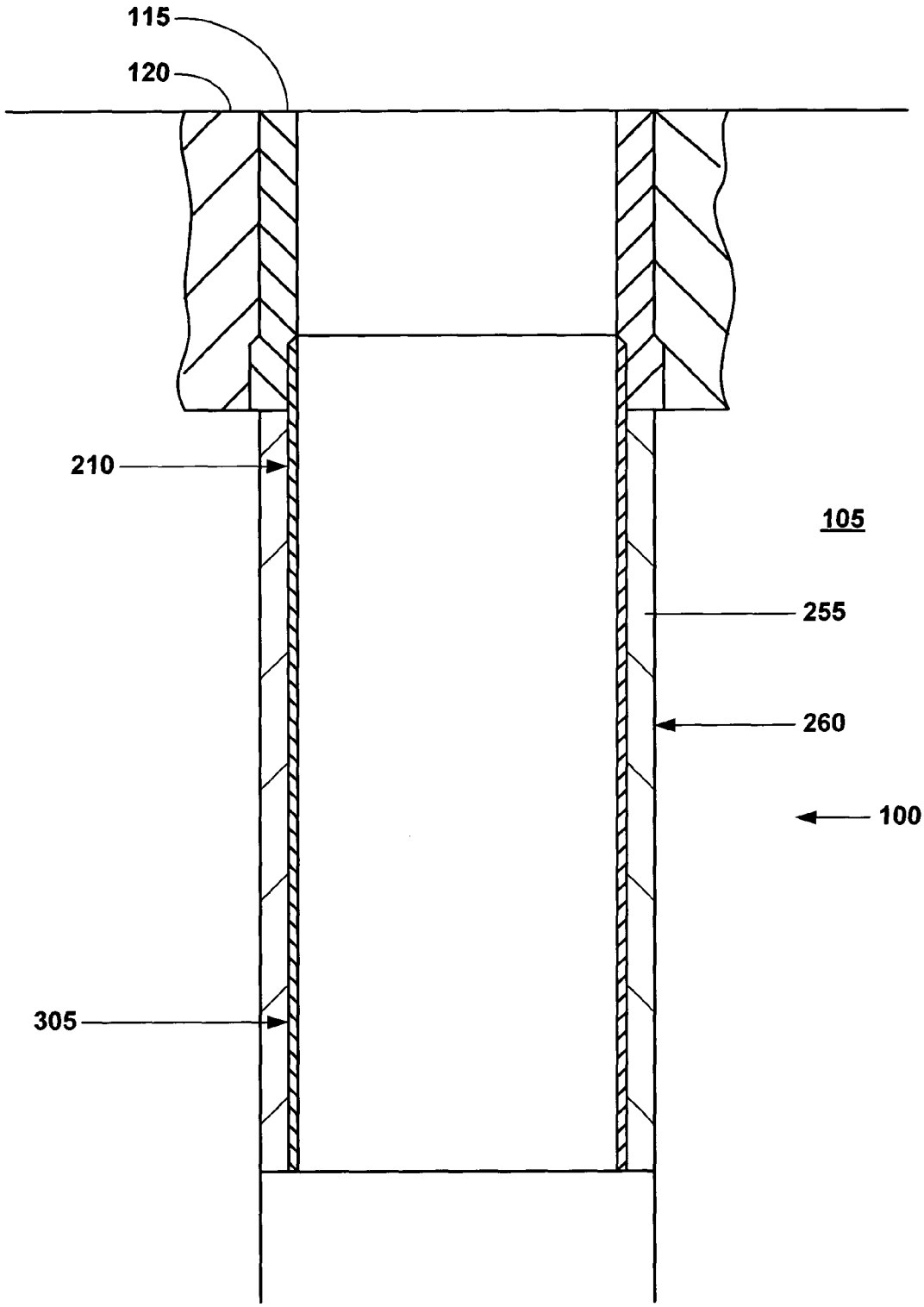
FIG. 20 is a cross-sectional view illustrating the removal of the bottom portion of the radially expanded shoe of the apparatus of FIG. 19.

As illustrated in FIG. 20, the bottom portion 305*c* of the shoe 305 may then be removed by drilling out the bottom portion of the shoe using conventional drilling methods. The wellbore 100 may then be extended in a conventional manner using a conventional drilling assembly. In a preferred embodiment, the inside diameter of the extended portion of the wellbore is greater than the inside diameter of the radially expanded shoe 305.

The method of FIGS. 12–20 may be repeatedly performed in order to provide a mono-diameter wellbore casing that includes overlapping wellbore casings. The overlapping wellbore casing preferably include outer annular layers of fluidic sealing material. Alternatively, the outer annular layers of fluidic sealing material may be omitted. In this manner, a mono-diameter wellbore casing may be formed within the subterranean formation that extends for tens of thousands of feet. More generally still, the teachings of FIGS. 12–20 may be used to form a mono-diameter wellbore casing, a pipeline, a structural support, or a tunnel within a subterranean formation at any orientation from the vertical to the horizontal.

In a preferred embodiment, the formation of a mono-diameter wellbore casing, as illustrated in FIGS. 12–20, is further provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, and (22) U.S. provisional patent application Ser. No. 60/262,434, filed on Jan. 17, 2001, the disclosures of which are incorporated herein by reference.

In several alternative embodiments, the apparatus 200 and 300 are used to form and/or repair wellbore casings, pipelines, and/or structural supports.

In several alternative embodiments, the folded geometries of the shoes 215 and 305 are provided in accordance with the teachings of U.S. Pat. Nos. 5,425,559 and/or 5,794,702, the disclosures of which are incorporated herein by reference.

An apparatus for forming a wellbore casing in a borehole located in a subterranean formation including a preexisting wellbore casing has been described that includes a support member including a first fluid passage, an expansion cone coupled to the support member including a second fluid passage fluidicly coupled to the first fluid passage, an expandable tubular liner movably coupled to the expansion cone, and an expandable shoe coupled to the expandable tubular liner. In a preferred embodiment, the expansion cone is expandable. In a preferred embodiment, the expandable shoe includes a valveable fluid passage for controlling the flow of fluidic materials out of the expandable shoe. In a preferred embodiment, the expandable shoe includes: an expandable portion and a remaining portion, wherein the outer circumference of the expandable portion is greater than the outer circumference of the remaining portion. In a preferred embodiment, the expandable portion includes: one or more inward folds. In a preferred embodiment, the expandable portion includes: one or more corrugations. In a preferred embodiment, the expandable shoe includes: one or more inward folds. In a preferred embodiment, the expandable shoe includes: one or more corrugations.

A shoe has also been described that includes an upper annular portion, an intermediate annular portion, and a lower annular portion, wherein the intermediate annular portion has an outer circumference that is larger than the outer circumferences of the upper and lower annular portions. In a preferred embodiment, the lower annular portion includes a valveable fluid passage for controlling the flow of fluidic materials out of the shoe. In a preferred embodiment, the intermediate portion includes one or more inward folds. In a preferred embodiment, the intermediate portion includes one or more corrugations.

A method of forming a wellbore casing in a subterranean formation having a preexisting wellbore casing positioned in a borehole has also been described that includes installing a tubular liner, an expansion cone, and a shoe in the borehole, radially expanding at least a portion of the shoe by injecting a fluidic material into the shoe, and radially expanding at least a portion of the tubular liner by injecting a fluidic material into the borehole below the expansion cone. In a preferred embodiment, the method further includes radially expanding the expansion cone. In a preferred embodiment, the method further includes lowering the expansion cone into the radially expanded portion of the shoe, and radially expanding the expansion cone. In a preferred embodiment, the method further includes radially expanding at least a portion of the shoe and the tubular liner by injecting a fluidic material into the borehole below the radially expanded expansion cone. In a preferred embodiment, the method further includes injecting a hardenable fluidic sealing material into an annulus between the tubular liner and the borehole. In a preferred embodiment, the method further includes radially expanding at least a portion of the preexisting wellbore casing. In a preferred embodiment, the method further includes overlapping a portion of the radially expanded tubular liner with a portion of the preexisting wellbore casing. In a preferred embodiment, the inside diameter of the radially expanded tubular liner is substantially equal to the inside diameter of a nonoverlapping portion of the preexisting wellbore casing. In a preferred embodiment, the method further includes applying an axial force to the expansion cone. In a preferred embodiment, the inside diameter of the radially expanded shoe is greater than or equal to the inside diameter of the radially expanded tubular liner.

An apparatus for forming a wellbore casing in a subterranean formation having a preexisting wellbore casing positioned in a borehole has also been described that includes means for installing a tubular liner, an expansion cone, and a shoe in the borehole, means for radially expanding at least a portion of the shoe, and means for radially expanding at least a portion of the tubular liner. In a preferred embodiment, the apparatus further includes means for radially expanding the expansion cone. In a preferred embodiment, the apparatus further includes means for lowering the expansion cone into the radially expanded portion of the shoe, and means for radially expanding the expansion cone. In a preferred embodiment, the apparatus further includes means for injecting a fluidic material into the borehole below the radially expanded expansion cone. In a preferred embodiment, the apparatus further includes means for injecting a hardenable fluidic sealing material into an annulus between the tubular liner and the borehole. In a preferred embodiment, the apparatus further includes means for radially expanding at least a portion of the preexisting wellbore casing. In a preferred embodiment, the apparatus further includes means for overlapping a portion of the radially expanded tubular liner with a portion of the preexisting wellbore casing. In a preferred embodiment, the inside diameter of the radially expanded tubular liner is substantially equal to the inside diameter of a nonoverlapping portion of the preexisting wellbore casing. In a preferred embodiment, the apparatus further includes means for applying an axial force to the expansion cone. In a preferred embodiment, the inside diameter of the radially expanded shoe is greater than or equal to the inside diameter of the radially expanded tubular liner.

An apparatus for forming a wellbore casing within a subterranean formation including a preexisting wellbore casing positioned in a borehole has also been described that includes a tubular liner and means for radially expanding and coupling the tubular liner to an overlapping portion of the preexisting wellbore casing. The inside diameter of the radially expanded tubular liner is substantially equal to the inside diameter of a non-overlapping portion of the preexisting wellbore casing.

A wellbore casing positioned in a borehole within a subterranean formation has also been described that includes a first wellbore casing and a second wellbore casing coupled to and overlapping with the first wellbore casing, wherein the second wellbore casing is coupled to the first wellbore casing by the process of: installing the second wellbore casing, an expansion cone, and a shoe in the borehole, radially expanding at least a portion of the shoe by injecting a fluidic material into the shoe, and radially expanding at least a portion of the second wellbore casing by injecting a fluidic material into the borehole below the expansion cone. In a preferred embodiment, the process for forming the wellbore casing further includes radially expanding the expansion cone. In a preferred embodiment, the process for forming the wellbore casing further includes lowering the expansion cone into the radially expanded portion of the shoe, and radially expanding the expansion cone. In a preferred embodiment, the process for forming the wellbore casing further includes radially expanding at least a portion of the shoe and the second wellbore casing by injecting a fluidic material into the borehole below the radially expanded expansion cone. In a preferred embodiment, the process for forming the wellbore casing further includes injecting a hardenable fluidic sealing material into an annulus between the second wellbore casing and the borehole. In a preferred embodiment, the process for forming the wellbore casing further includes radially expanding at least a portion of the first wellbore casing. In a preferred embodiment, the process for forming the wellbore casing further includes overlapping a portion of the radially expanded second wellbore casing with a portion of the first wellbore casing. In a preferred embodiment, the inside diameter of the radially expanded second wellbore casing is substantially equal to the inside diameter of a nonoverlapping portion of the first wellbore casing. In a preferred embodiment, the process for forming the wellbore casing further includes applying an axial force to the expansion cone. In a preferred embodiment, the inside diameter of the radially expanded shoe is greater than or equal to the inside diameter of the radially expanded second wellbore casing.

A method of forming a tubular structure in a subterranean formation having a preexisting tubular member positioned in a borehole has also been described that includes installing a tubular liner, an expansion cone, and a shoe in the borehole, radially expanding at least a portion of the shoe by injecting a fluidic material into the shoe, and radially expanding at least a portion of the tubular liner by injecting a fluidic material into the borehole below the expansion cone. In a preferred embodiment, the method further includes radially expanding the expansion cone. In a preferred embodiment, the method further includes lowering the expansion cone into the radially expanded portion of the shoe, and radially expanding the expansion cone. In a preferred embodiment, the method further includes radially expanding at least a portion of the shoe and the tubular liner by injecting a fluidic material into the borehole below the radially expanded expansion cone. In a preferred embodiment, the method further includes injecting a hardenable fluidic sealing material into an annulus between the tubular liner and the borehole. In a preferred embodiment, the method further includes radially expanding at least a portion of the preexisting tubular member. In a preferred embodiment, the method further includes overlapping a portion of the radially expanded tubular liner with a portion of the preexisting tubular member. In a preferred embodiment, the inside diameter of the radially expanded tubular liner is substantially equal to the inside diameter of a nonoverlapping portion of the preexisting tubular member. In a preferred embodiment, the method further includes applying an axial force to the expansion cone. In a preferred embodiment, the inside diameter of the radially expanded shoe is greater than or equal to the inside diameter of the radially expanded tubular liner.

An apparatus for forming a tubular structure in a subterranean formation having a preexisting tubular member positioned in a borehole has also been described that includes means for installing a tubular liner, an expansion cone, and a shoe in the borehole, means for radially expanding at least a portion of the shoe, and means for radially expanding at least a portion of the tubular liner. In a preferred embodiment, the apparatus further includes means for radially expanding the expansion cone. In a preferred embodiment, the apparatus further includes means for lowering the expansion cone into the radially expanded portion of the shoe, and means for radially expanding the expansion cone. In a preferred embodiment, the apparatus further includes means for injecting a fluidic material into the borehole below the radially expanded expansion cone. In a preferred embodiment, the apparatus further includes means for injecting a hardenable fluidic sealing material into an annulus between the tubular liner and the borehole. In a preferred embodiment, the apparatus further includes means for radially expanding at least a portion of the preexisting tubular member. In a preferred embodiment, the apparatus further includes means for overlapping a portion of the radially expanded tubular liner with a portion of the preexisting tubular member. In a preferred embodiment, the inside diameter of the radially expanded tubular liner is substantially equal to the inside diameter of a nonoverlapping portion of the preexisting tubular member. In a preferred embodiment, the apparatus further includes means for applying an axial force to the expansion cone. In a preferred embodiment, the inside diameter of the radially expanded shoe is greater than or equal to the inside diameter of the radially expanded tubular liner.

An apparatus for forming a tubular structure within a subterranean formation including a preexisting tubular member positioned in a borehole has also been described that includes a tubular liner and means for radially expanding and coupling the tubular liner to an overlapping portion of the preexisting tubular member. The inside diameter of the radially expanded tubular liner is substantially equal to the inside diameter of a non-overlapping portion of the preexisting tubular member.

A tubular structure positioned in a borehole within a subterranean formation has also been described that includes a first tubular member and a second tubular member coupled to and overlapping with the first tubular member, wherein the second tubular member is coupled to the first tubular member by the process of: installing the second tubular member, an expansion cone, and a shoe in the borehole, radially expanding at least a portion of the shoe by injecting a fluidic material into the shoe, and radially expanding at least a portion of the second tubular member by injecting a fluidic material into the borehole below the expansion cone. In a preferred embodiment, the process for forming the tubular structure further includes radially expanding the expansion cone. In a preferred embodiment, the process for forming the tubular structure further includes lowering the expansion cone into the radially expanded portion of the shoe, and radially expanding the expansion cone. In a preferred embodiment, the process for forming the tubular structure further includes radially expanding at least a portion of the shoe and the second tubular member by injecting a fluidic material into the borehole below the radially expanded expansion cone. In a preferred embodiment, the process for forming the tubular structure further includes injecting a hardenable fluidic sealing material into an annulus between the second tubular member and the borehole. In a preferred embodiment, the process for forming the tubular structure further includes radially expanding at least a portion of the first tubular member. In a preferred embodiment, the process for forming the tubular structure further includes overlapping a portion of the radially expanded second tubular member with a portion of the first tubular member. In a preferred embodiment, the inside diameter of the radially expanded second tubular member is substantially equal to the inside diameter of a nonoverlapping portion of the first tubular member. In a preferred embodiment, the process for forming the tubular structure further includes applying an axial force to the expansion cone. In a preferred embodiment, the inside diameter of the radially expanded shoe is greater than or equal to the inside diameter of the radially expanded second tubular member.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for forming a wellbore casing in a borehole located in a subterranean formation including a preexisting weilbore casing, comprising:

a support member including a first fluid passage;

an expansion cone coupled to the support member including a second fluid passage fluidicly coupled to the first fluid passage;

an expandable tubular liner movably coupled to the expansion cone; and an expandable shoe that defines an interior region for containing fluidic materials coupled to the expandable tubular liner.

2. The apparatus of claim 1, wherein the expansion cone is expandable.

3. The apparatus of claim 1, wherein the expandable shoe includes a valveable fluid passage for controlling the flow of fluidic materials out of the expandable shoe.

4. The apparatus of claim 1, wherein the expandable shoe includes:

an expandable portion; and a remaining portion coupled to the expandable portion;

wherein the outer circumference of the expandable portion is greater than the outer circumference of the remaining portion.

5. The apparatus of claim 4, wherein the expandable portion includes:

one or more inward folds.

6. The apparatus of claim 4, wherein the expandable portion includes:

one or more corrugations.

7. The apparatus of claim 1, wherein the expandable shoe includes:

one or more inward folds.

8. The apparatus of claim 1, wherein the expandable shoe includes:

one or more corrugations.

9. A shoe, comprising:

an upper annular portion;

an expandable intermediate annular portion coupled to the upper annular portion; and a lower annular portion coupled to the intermediate portion;

wherein, when the intermediate annular portion is expanded, the intermediate annular portion has an outer circumference that is larger than the outer circumferences of the upper and lower annular portions.

10. The shoe of claim 9, wherein the lower annular portion includes a valveable fluid passage for controlling the flow of fluidic materials out of the shoe.

11. The shoe of claim 9, wherein the intermediate portion includes:

one or more inward folds.

12. The shoe of claim 9, wherein the intermediate portion includes:

one or more corrugations.

13. A method of forming a wellbore casing in a subterranean formation having a preexisting wellbore casing positioned in a borehole, comprising:

installing a tubular liner, an expansion cone, and a shoe that defines an interior region for containing fluidic materials in the borehole;

radially expanding at least a portion of the shoe by injecting a fluidic material into the interior region of the shoe; and radially expanding at least a portion of the tubular liner by injecting a fluidic material into the borehole below the expansion cone.

14. The method of claim 13, further comprising:

radially expanding the expansion cone.

15. The method of claim 13, further comprising:

lowering the expansion cone into the radially expanded portion of the shoe; and radially expanding the expansion cone.

16. The method of claim 15, further comprising:

radially expanding at least a portion of the shoe and the tubular liner by injecting a fluidic material into the borehole below the radially expanded expansion cone.

17. The method of claim 13, further comprising:

radially expanding at least a portion of the preexisting wellbore casing.

18. The method of claim 17, further comprising:

overlapping a portion of the radially expanded tubular liner with a portion of the preexisting wellbore casing.

19. The method of claim 18, wherein the inside diameter of the radially expanded tubular liner is substantially equal to or greater than the inside diameter of a nonoverlapping portion of the preexisting wellbore casing.

20. The method of claim 17, further comprising:

applying an axial force to the expansion cone.

21. The method of claim 13, wherein the inside diameter of the radially expanded shoe is greater than or substantially equal to the inside diameter of the radially expanded tubular liner.

22. A method of forming a tubular structure in a subterranean formation having a preexisting tubular member positioned in a borehole, comprising:

installing a tubular liner, an expansion cone, and a shoe that defines an interior region for containing fluidic materials in the borehole;

radially expanding at least a portion of the shoe by injecting a fluidic material into the interior region of the shoe; and radially expanding at least a portion of the tubular liner by injecting a fluidic material into the borehole below the expansion cone.

23. The method of claim 22, further comprising:

radially expanding the expansion cone.

24. The method of claim 22, further comprising:

lowering the expansion cone into the radially expanded portion of the shoe; and radially expanding the expansion cone.

25. The method of claim 24, further comprising:

radially expanding at least a portion of the shoe and the tubular liner by injecting a fluidic material into the borehole below the radially expanded expansion cone.

26. The method of claim 22, further comprising:

radially expanding at least a portion of the preexisting tubular member.

27. The method of claim 26, further comprising:

overlapping a portion of the radially expanded tubular liner with a portion of the preexisting tubular member to provide a load bearing interface and a fluidic seal.

28. The method of claim 27, wherein the inside diameter of the radially expanded tubular liner is substantially equal to the inside diameter of a nonoverlapping portion of the preexisting tubular member.

29. The method of claim 26, further comprising:
applying an axial force to the expansion cone.

30. The method of claim 22, wherein the inside diameter of the radially expanded shoe is greater than or substantially equal to the inside diameter of the radially expanded tubular liner.

31. An apparatus for forming a wellbore casing in a borehole located in a subterranean formation including a preexisting wellbore casing, comprising:
a support member including a first fluid passage;
an expandable expansion cone coupled to the support member including a second fluid passage fluidicly coupled to the first fluid passage;
an expandable tubular liner movably coupled to the expansion cone; and
an expandable shoe that defines an interior region for containing fluidic materials coupled to the expandable tubular liner comprising:
a valveable fluid passage for controlling the flow of fluidic materials out of the expandable shoe;
an expandable portion including one or more inward folds; and
a remaining portion coupled to the expandable portion;
wherein the outer circumference of the expandable portion is greater than the outer circumference of the remaining portion.

32. A shoe, comprising:
an upper annular portion;
an intermediate annular portion coupled to the upper annular portion including one or more inward folds that are adapted to be unfolded; and
a lower annular portion coupled to the intermediate portion including a valveable fluid passage for controlling the flow of fluidic materials out of the shoe;
wherein, when the one or more inward folds are unfolded, the intermediate annular portion has an outer circumference that is larger than the outer circumferences of the upper and lower annular portions.

33. A method of forming a wellbore casing in a subterranean formation having a preexisting wellbore casing positioned in a borehole, comprising:
installing a tubular liner, an expansion cone, and a shoe in the borehole;
radially expanding at least a portion of the shoe by injecting a fluidic material into the shoe;
lowering the expansion cone into the radially expanded portion of the shoe; radially expanding the expansion cone;
radially expanding at least a portion of the tubular liner by injecting a fluidic material into the borehole below the expansion cone; and
overlapping a portion of the radially expanded tubular liner with a portion of the preexisting wellbore casing;
wherein the inside diameter of the radially expanded shoe is greater than or equal to the inside diameter of the radially expanded tubular liner; and
wherein the inside diameter of the radially expanded tubular liner is equal to or greater than the inside diameter of a nonoverlapping portion of the preexisting wellbore casing.

34. A method of forming a tubular structure in a subterranean formation having a preexisting tubular member positioned in a borehole, comprising:
installing a tubular liner, an expansion cone, and a shoe in the borehole;
radially expanding at least a portion of the shoe by injecting a fluidic material into the shoe;
lowering the expansion cone into the radially expanded portion of the shoe;
radially expanding the expansion cone;
radially expanding at least a portion of the tubular liner by injecting a fluidic material into the borehole below the radially expanded expansion cone; and
overlapping a portion of the radially expanded tubular liner with a portion of the preexisting tubular member to provide a load bearing interface and a fluidic seal;
wherein the inside diameter of the radially expanded shoe is greater than or equal to the inside diameter of the radially expanded tubular liner; and
wherein the inside diameter of the radially expanded tubular liner is equal to the inside diameter of a nonoverlapping portion of the preexisting tubular member.

35. An apparatus for forming a wellbore casing in a borehole located in a subterranean formation including a preexisting wellbore casing, comprising:
a support member;
an expansion device coupled to the support member;
an expandable tubular liner movably coupled to the expansion device; and
an expandable shoe that defines an interior region for containing fluidic materials coupled to the expandable tubular liner.

36. A method of forming a welibore casing in a subterranean formation having a preexisting wellbore casing positioned in a borehole, comprising:
installing a tubular liner, an expansion device, and a shoe that defines an interior region for containing fluidic materials in the borehole;
radially expanding at least a portion of the shoe by injecting a fluidic material into the interior region of the shoe; and
radially expanding at least a portion of the tubular liner using the expansion device.

37. A method of forming a tubular structure in a subterranean formation having a preexisting tubular member positioned in a borehole, comprising:
installing a tubular liner, an expansion device, and a shoe that defines an interior region for containing fluidic materials in the borehole;
radially expanding at least a portion of the shoe by injecting a fluidic material into the interior region of the shoe; and
radially expanding at least a portion of the tubular liner using the expansion device.

38. A method of forming a wellbore casing in a subterranean formation having a preexisting wellbore casing positioned in a borehole, comprising:
installing a tubular liner, an expansion device, and a shoe in the borehole;
radially expanding at least a portion of the shoe by injecting a fluidic material into the shoe;
lowering the expansion device into the radially expanded portion of the shoe;
radially expanding the expansion device;
radially expanding at least a portion of the tubular liner by injecting a fluidic material into the borehole below the expansion device; and
overlapping a portion of the radially expanded tubular liner with a portion of the preexisting wellbore casing;

wherein the inside diameter of the radially expanded shoe is greater than or equal to the inside diameter of the radially expanded tubular liner; and wherein the inside diameter of the radially expanded tubular liner is equal to or greater than the inside diameter of a nonoverlapping portion of the preexisting wellbore casing.

39. A method of forming a tubular structure in a subterranean formation having a preexisting tubular member positioned in a borehole, comprising:

installing a tubular liner, an expansion device, and a shoe in the borehole;

radially expanding at least a portion of the shoe by injecting a fluidic material into the shoe;

lowering the expansion device into the radially expanded portion of the shoe;

radially expanding the expansion device;

radially expanding at least a portion of the tubular liner by injecting a fluidic material into the borehole below the radially expanded expansion device; and overlapping a portion of the radially expanded tubular liner with a portion of the preexisting tubular member to provide a load bearing interface and a fluidic seal;

wherein the inside diameter of the radially expanded shoe is greater than or equal to the inside diameter of the radially expanded tubular liner; and wherein the inside diameter of the radially expanded tubular liner is equal to the inside diameter of a nonoverlapping portion of the preexisting tubular member.

* * * * *